US007050746B2

(12) United States Patent
Hirai et al.

(10) Patent No.: US 7,050,746 B2
(45) Date of Patent: May 23, 2006

(54) IMAGE FORMING APPARATUS WHICH CONTROLS TRANSFERRING TIMING TO THE PAPER ACCORDING TO A CHANGE OF PROCESS SPEED

(75) Inventors: Masahide Hirai, Shizuoka (JP); Akihiro Fujimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 10/781,793

(22) Filed: Feb. 20, 2004

(65) Prior Publication Data

US 2004/0165915 A1 Aug. 26, 2004

(30) Foreign Application Priority Data

Feb. 24, 2003 (JP) ..... 2003-045916
Aug. 4, 2003 (JP) ..... 2003-286131

(51) Int. Cl.
*G03G 15/16* (2006.01)

(52) U.S. Cl. ..... 399/302; 399/66

(58) Field of Classification Search ..... 399/302, 399/303, 308, 312
See application file for complete search history.

(56) References Cited

U.S. PATENT DOCUMENTS 5,072,244 A 12/1991 Aoki et al. ..... 346/160
6,324,358 B1 * 11/2001 Sahara ..... 399/66
6,501,931 B1 * 12/2002 Matsumoto ..... 399/167

FOREIGN PATENT DOCUMENTS

JP 1-142673 6/1989
JP 10-020706 1/1998
JP 11-160938 6/1999
JP 2002132008 A * 5/2002
JP 2002318479 A * 10/2002
JP 2003215945 A * 7/2003

OTHER PUBLICATIONS

Patent Abstracts of Japan Publication No. 11-160938 (Jun. 18, 1999).
Patent Abstracts of Japan Publication No. 10-20706 (Jan. 23, 1998).

* cited by examiner

*Primary Examiner*—Quana Grainger
(74) *Attorney, Agent, or Firm*—Fitzpatrick, Cella, Harper & Scinto

(57) ABSTRACT

The image forming apparatus includes a photosensitive drum, an image forming unit, an intermediate transfer belt, a circuit of a drive motor which outputs information on a moving distance, a registration roller, a CPU which calculates the predetermined timing on the basis of the information on the moving distance output by the circuit of the drive motor at the time when a rotation speed of the intermediate transfer belt is switched from a first process speed to a second process speed, and a memory storing the information on the predetermined timing calculated by the CPU, wherein the CPU controls the registration roller so as to start the conveyance of the recording material at the predetermined timing stored in the memory. Consequently, a positional relation between a leading end of the recording material and a leading end of the image formed on the recording material can be set as a desired positional relation.

12 Claims, 16 Drawing Sheets

IMAGE FORMING APPARATUS WHICH CONTROLS TRANSFERRING TIMING TO THE PAPER ACCORDING TO A CHANGE OF PROCESS SPEED

BACKGROUND OF THE INVENTION

1. Field of the Invention

The present invention relates to an image forming apparatus and an image forming method.

2. Related Background Art

Up to now, as an image forming apparatus for forming an image on a recording material such as paper, there has been known an image forming apparatus which uses an electrophotographic process.

For example, a color image forming apparatus primarily transfers plural colors of toners, which are formed on plural photosensitive drums, onto an intermediate transfer member sequentially to form toner images. After that, the apparatus secondarily transfers the toner images on the intermediate transfer member onto a recording material, and heat-fixes the toner images on the recording material by a fixing device to thereby form a color image.

In addition, in the image forming apparatus using the electrophotographic process, in order to cope with various recording materials (media), for example, in the case in which an image is formed on cardboard, rough paper, OHT, or the like, it is desirable to perform a fixing step at a process speed lower than a normal image forming speed in order to secure a fixing property and image transparency.

Further, in the case in which an image is formed on a thick paper (e.g., cardboard), rough paper, OHT, or the like, it is conceivable that a method of performing an image forming operation at a second process speed lower than a normal process speed (processing speed of an image forming operation such as a conveying speed of a recording material) is adopted. However, all steps of an image forming process (charging, exposure, development, primary transfer, secondary transfer, and fixing) of the electrophotographic process may be performed at a process speed associated with each medium. However, it is necessary to perform optimization of an applied bias voltage in charging, development, transfer, and the like with respect to each process speed in order to cope with plural process speeds. In particular, it is very difficult to optimally set a charging bias voltage and a development bias voltage with respect to each process speed such that an image of a desired quality is formed with respect to a structure and a composition of a photosensitive member and a composition of a toner.

Thus, it is conceivable that a method of performing an image forming process up to transfer of toner images onto a recording material at a first process speed and performing a fixing step for heat-fixing the toner images on the recording material at a second process speed is adopted.

With the former method, if a sufficient conveying distance (at least a length of the recording material) is secured between a secondary transfer unit and a fixing unit, it is possible to perform only the fixing step at the second process speed. However, it is difficult to reduce a size of the apparatus because the sufficient conveying distance is required between the secondary transfer unit and the fixing unit.

Thus, it is possible to always stabilize an image quality at the time of image formation regardless of a set mode by performing the image forming process from the charging step to the primary transfer step while keeping a constant process speed (first process speed) and switching a process speed in the middle of the image forming process in the secondary transfer step and the fixing step according to a mode (setting on whether the fixing step is performed at the first process speed or the second process speed).

However, in the case in which a structure for performing the charging step to the primary transfer step at the first process speed and performing the secondary transfer step and the fixing step at the second process step is adopted, it is necessary to adjust a positional relation between an image leading end and a recording material leading end (distance from the recording material leading end to the image leading end) according to fluctuations in the number of rotations of a motor at the time when the process speed is changed, time lag at the time of building-up and building-down of rotation of the motor, and the like.

SUMMARY OF THE INVENTION.

The present invention has been devised in view of the above-mentioned points, and it is an object of the present invention to provide an improved image forming apparatus.

In addition, it is another object of the present invention to provide an image forming apparatus which can set a positional relation between a recording material leading end and an image leading end of an image formed on the recording material to a desired positional relation.

It is another object of the present invention to provide an image forming apparatus, including: an image bearing member for bearing a toner image; an image forming unit for forming a toner image on the image bearing member; an intermediate transfer member to which the toner image is primarily transferred from the image bearing member, the intermediate transfer member rotating while being in contact with the image bearing member; an output unit for outputting information on a moving distance at the time when the intermediate transfer member rotates; a conveying unit which, in an attempt to secondarily transfer the toner image on the intermediate transfer member to a predetermined position on a recording material, starts conveyance of the recording material at a predetermined timing; a calculation unit for calculating the predetermined timing on a basis of the information on the moving distance which is output by the output unit at the time when a rotation speed of the intermediate transfer member is switched from a first speed to a second speed lower than the first speed; a storage unit for storing information on the predetermined timing calculated by the calculation unit; and a control unit for controlling the rotation of the intermediate transfer member and the conveyance of the recording material by the conveying unit, wherein, in the case in which the rotation speed of the intermediate transfer member is switched from the first speed to the second speed lower than the first speed to secondarily transfer the toner image on the intermediate transfer member to the predetermined position on the recording material, the control unit controls the conveying unit to start the conveyance of the recording material at the predetermined timing stored in the storage unit.

These and other objects, features and advantages of the present invention will become more apparent upon reading of the following detailed description along with the accompanied drawings.

DESCRIPTION OF THE PREFERRED EMBODIMENTS

First Embodiment

Figure 1:
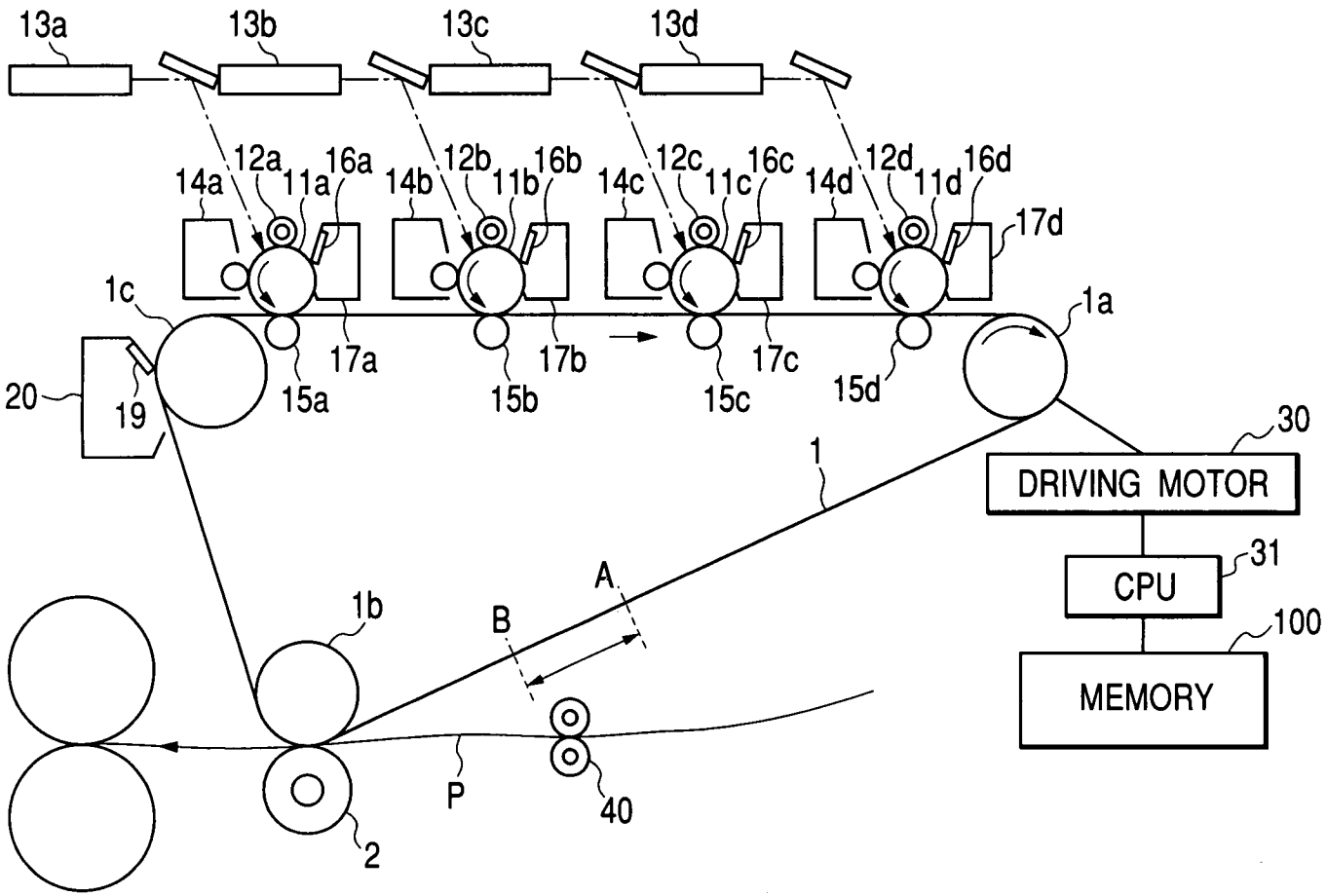
FIG. 1 is a sectional view showing a schematic structure of an image forming apparatus according to a first embodiment of the present invention.
Figure 2:
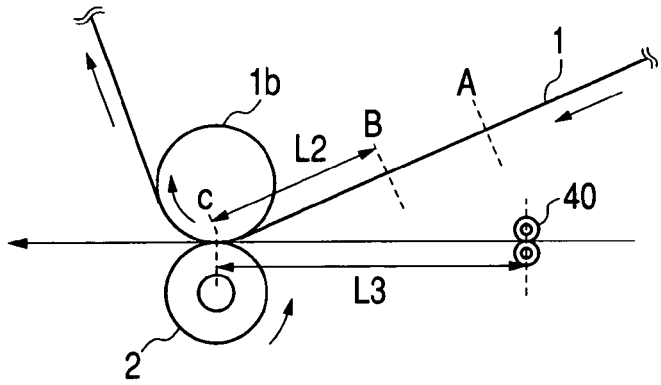
FIG. 2 is a sectional view showing a structure around a secondary transfer nip area.

FIG. 1 is a sectional view showing a schematic structure of a "color image forming apparatus" according to the first embodiment FIG. 2 is a sectional view showing a structure around a secondary transfer nip area.

This structure has photosensitive drums 11*a* to 11*d* corresponding to color toners of a first color of yellow, a second color of magenta, a third color of cyan, and a fourth color of black, respectively. An intermediate transfer belt 1 serving as an intermediate transfer member is in contact with the photosensitive drums 11*a* to 11*d* in primary transfer units thereof, respectively.

The photosensitive drums are arranged along a moving direction of the intermediate transfer belt 1 in the following order from the upstream side: the photosensitive drum 11*a* of the first color (yellow), the photosensitive drum 11*b* of the second color (magenta) located closest to the photosensitive drum 11*a* on the downstream side thereof, the photosensitive drum 11*c* of the third color (cyan) located closest to the photosensitive drum 11*b* on the downstream side thereof, and the photosensitive drum 11*d* of the fourth color (black) located closest to the photosensitive drum 11*c* on the downstream side thereof.

A resistance of the intermediate transfer belt 1 is preferably $1\times10^6$ to $1\times10^{12}$ Ω·cm in volume resistivity. As the intermediate transfer belt 1, a belt of urethane resin, fluorine resin, polyamide synthetic fiber resin, or polyimide resin, a belt of an elastic material such as silicone rubber or hydrin rubber, or a belt of a material which is obtained by dispersing carbon or conductive powder to those materials to adjust resistance thereof can be used.

In the first embodiment, an endless belt of a single layer with thickness of 0.1 mm, volume resistivity of which is adjusted to $1\times10^9$ Ω·cm by dispersing carbon in polyimide, is used as the intermediate transfer belt 1.

The intermediate transfer belt 1 is suspended by three rollers of a drive roller 1*a*, a separation roller 1*b*, and a support roller 1*c* which are arranged on the inner side of the intermediate transfer belt 1.

As a tension of the intermediate transfer belt 1, although depending upon a material, it is desirable to set an elongation percentage to 1% or less so as to prevent breakage or permanent distortion of the intermediate transfer member from occurring. In the first embodiment, the tension is set such that a load of 150 N is applied to the intermediate transfer belt 1.

In the primary transfer units, primary transfer rollers 15*a* to 15*d*, which are formed by coating a cored bar with an elastic material of a medium resistance (volume resistivity of $1\times10^4$ to $1\times10^7$ Ω·cm), are arranged to be opposed to the photosensitive drums 11*a* to 11*d*, respectively, so as to nip the intermediate transfer belt 1.

A secondary transfer roller 2 is a roller, which is formed by coating a cored bar with an EPDM foamed layer having a resistance value of the medium resistance (volume resistivity of $1\times10^4$ to $1\times10^7$ Ω·cm), and is arranged in a position opposed to the separation roller 1*b* so as to nip the intermediate transfer belt 1 and a recording material.

An image forming operation of the image forming apparatus will be described together with an image forming process thereof.

A photosensitive drum 11*a* rotates at a predetermined process speed (here, 0.117 m/s) in a direction of an arrow and is uniformly charged by a primary charger 12*a*. An electrostatic latent image is formed on the photosensitive drum 11*a* by a laser beam from a scanner 13*a* which is modulated by an image information signal sent from a host computer.

An intensity and an irradiation spot diameter of the laser beam are set properly according to a resolution of the image forming apparatus and a desired image concentration. The electrostatic latent image on the photosensitive drum 11*a* is formed by maintaining a potential of a part of the photosensitive drum 11*a*, where the laser beam is irradiated, at a light portion potential VL (−150 V) and maintaining a potential of the remaining part thereof, where the laser beam is not irradiated, at a dark portion potential VD (−550 V) charged by the primary charger 12*a*.

The electrostatic latent image reaches a part, where the photosensitive drum 11*a* is opposed to the developing device 14*a*, according to the rotation of the photosensitive drum 11*a*. Toners charged in an identical polarity (negative polarity in this embodiment) are supplied to the electrostatic latent image according to an action of a developing electric field by a developing bias (voltage) power supply (not shown), and the electrostatic latent image is visualized.

The developing device in the first embodiment is a developing device of a contact development system. A developing bias Vdc (−400 V) is applied to a developing roller which rotates in contact with the photosensitive drum 11.

In full-color image formation, toner images are formed in the same manner for the photosensitive drums 11*a* to 11*d* corresponding to the respective colors and are primarily transferred onto the intermediate transfer belt 1, which serves as the intermediate transfer member, sequentially in respective primary transfer nips to form a multi-color image.

The intermediate transfer belt 1 is rotated in a direction of an arrow by the drive roller 1*a* in synchronization with the respective photosensitive drums 11*a* to 11*d* at a predetermined process speed (here, 0.117 m/s).

In the respective primary transfer nips formed by the intermediate transfer belt 1 and the photosensitive drums 11*a* to 11*d*, toner images are primarily transferred by an electric field, which is formed in the primary transfer nip area by a bias (here, +500 V) of a polarity opposite to the polarity of the toners applied to the primary transfer rollers 15*a* to 15*d* which are in contact with the rear surface of the intermediate transfer belt 1.

As described above, toner images are formed on the photosensitive drum 1 serving as an image bearing member by image forming units composed of the primary chargers 12, the scanners 13, the developing devices 14, and the like, and the toner images on the photosensitive drum 1 are primarily transferred onto the intermediate transfer belt 1 by the primary transfer rollers 15.

When the intermediate transfer belt 1 has passed the primary transfer nip between the intermediate transfer belt 1 and the photosensitive drum 11*d*, the full color image is borne on the intermediate transfer belt 1, and the primary transfer step is completed.

On the other hand, the surfaces of the photosensitive drums 11*a* to 11*d*, which have undergone the primary transfer of the toner images, are cleaned while primary transfer residual toners and the like are removed from the surfaces by drum cleaning devices 16*a* to 16*d*, and the photosensitive drums 11*a* to 11*d* are prepared for the next image forming process.

Waste toners removed by the drum cleaning devices 16*a* to 16*d* are collected in waste toner boxes 17*a* to 17*d* adjacent to the respective drum cleaning devices.

Next, one recording material P is taken out by paper feeding means (not shown) and passed through the secondary transfer nip area. The recording material P stops and stands by in a registration roller 40 after the paper feeding in order to align a leading end position of the recording material P and an image leading end position. The registration roller 40 is driven at timing for effecting a leading end registration in synchronization with the image leading end to feed the recording material P to the secondary transfer nip area again.

At this point, a bias (here, +2 kV) of a polarity opposite to a polarity of the toners is applied to the secondary transfer roller 2, and the toner images are transferred onto the recording material P from the intermediate transfer belt 1.

The recording material P having an unfixed color image transferred thereon, which has exited the secondary transfer nip area, reaches a fixing device 18 and is heated and pressurized, whereby a permanently fixed image is obtained.

Residual toners after the secondary transfer are removed from the surface of the intermediate transfer belt 1, from which the toner images have been transferred onto the recording material P, by an intermediate transfer member cleaning blade 19 made of urethane rubber. The removed residual toners are collected in an intermediate transfer member waste toner box 20.

In the first embodiment, a DC motor is used for a drive motor 30 of the intermediate transfer member 1. The drive roller 1*a* is driven to rotate in a direction of an arrow.

Usually, at the time of image formation, all steps of the image formation are performed at a normal process speed (first process speed). On the other hand, at the time of a thick paper mode (cardboard mode), a rough mode, an OHT mode, and the like, in order to secure a fixing property and improve gloss and transparency, a structure for switching a process speed after the primary transfer and performing the secondary transfer and fixing steps at a second process speed is adopted.

From the start of the image formation, images are formed sequentially in an order of a first color of yellow, a second color of magenta, a third color of cyan, and a fourth color of black, and toner images of the respective color toners are multiply transferred onto the intermediate transfer belt 1 in the first transfer units. In this embodiment, after the image of the fourth color of black is transferred onto the intermediate transfer belt 1, switching of a speed from the first process speed to the second process speed is started.

In FIG. 1, "A" indicates a leading end position of an image at the time when the speed switching is started. "B" indicates a leading end position of an image at the point when the switching to the second process speed is completed including building-down time for the rotation of the motor at the time of the speed switching. In addition, in FIG. 2, L2 indicates a distance from the image leading end position "B" to the secondary transfer unit 2 at the point when the switching to the second process speed is completed. Note that "A" is shown for convenience of explaining speed switching timing and the image leading end position. As it is evident from the description below, it is not specifically necessary to detect this image leading end position. The image leading end position is provided in advance as a default value for certain detection timing.

A motor rotation number detection circuit for detecting the number of motor rotations is provided in the drive motor 30 to make it possible to detect the number of rotations by detecting a signal from the drive motor 30. A CPU 31 receives a signal detected by the motor rotation number detection circuit of the drive motor 30 and performs an arithmetic operation to thereby output information on a conveying distance (moving distance where the intermediate transfer belt moves) of the intermediate transfer belt 1 from the number of rotations of the motor 30.

Then, the CPU 31 further calculates paper feeding timing at the time when a rotation speed of the intermediate transfer belt 1 is switched from the first process speed to the second process speed on the basis of the information on the moving distance at the time when the intermediate transfer belt 1 rotates. In addition, a result of this calculation is stored in a writable/readable memory 100. At the time of image formation, the recording material P is conveyed from the registration roller 40 on the basis of the paper feeding timing stored in the memory 100.

Note that the CPU 31 controls the rotation of the intermediate transfer belt 1 by the drive motor 30 and also controls the paper feeding timing (conveyance start timing) of the recording material P to the secondary transfer roller 2 by the registration roller 40.

In the first embodiment, the process speed at the time of normal image formation (first process speed) is set to 0.09 m/s, and the second process speed is set to 0.045 m/s, which is half the first process speed, as the cardboard and rough paper mode.

In measuring and calculating the number of rotations of the drive motor 30 to feed it back to paper feeding timing at the time of image formation, assuming that a distance from the image leading end position B at the time of completion of the switching to the second process speed to a secondary transfer nip C is L2, in the case in which a relation between the distance L2 and a distance L3 from the registration roller 40 to the secondary transfer nip C is L2>L3, it becomes possible to effect the image leading end registration by causing paper to stand by for a distance L'=L2−L3 after the switching to the second process speed and then feeding the paper. On the other hand, in the case of L3>L2 as shown in the figure, it is necessary to set paper feeding start timing before the completion of speed switching. Thus, in a system for measuring and calculating the number of rotations of the motor after the completion of the switching to the second process speed and then feeding back the number of rotations to the paper feeding timing, it is likely that paper feeding is late.

In the first embodiment, at the startup of an initial sequence at the time of input of a power supply (e.g., a sequence for performing preparation before it becomes possible to start image formation such as environmental detection and resistance detection of a roller), the CPU 31 carries out a paper feeding timing acquisition sequence, detects building-down state of motor rotation at the time of the speed switching of the motor, and calculates a conveying distance for the building-down of the intermediate transfer belt from a result of the detection. Then, the CPU 31 calculates paper feeding timing on the basis of a result of the calculation, stores a calculated value in the memory 100, and performs a paper feeding operation on the basis of the stored value at the time of image formation. Consequently, since it is unnecessary to measure the number of motor rotations and feed it back to paper feeding timing at the time of every image formation, it becomes possible to always feed paper at optimal paper feeding timing regardless of a structure of the apparatus such as the relation of L2 and L3.

An operation of this embodiment will be hereinafter described more specifically.

At the time of initial rotation such as the time of input of a power supply, it is possible to carry out the paper feeding timing acquisition sequence at an arbitrary timing. However, in this embodiment, the paper feeding timing acquisition sequence is carried out at the time of initial rotation and after the end of the initial sequence before the image formation. Note that the initial rotation means an operation for rotating the photosensitive drum 11 in order to charge the surface of the photosensitive drum 11 to a predetermined potential such that an image forming operation becomes possible. Further, the initial sequence is a sequence which is performed at the time of execution of the initial rotation, and the paper feeding timing acquisition sequence is executed after the end of the initial sequence. In a state in which the motor is driven at the first process speed after the end of the initial sequence, the CPU 31 starts the paper feeding timing acquisition sequence. First, after starting detection of the number of rotations of the motor, the CPU 31 switches the speed of the motor from the first process speed to the second process speed after a fixed time.

Then, the CPU 31 ends the detection at the point when the number of motor rotations is completely switched to the second process speed calculates a total moving distance of the intermediate transfer belt at the time of building-down based on a total number of rotations of the motor from the start until the end of the detection of the number of motor rotations, and determines paper feeding timing on the basis of a result of the calculation. The CPU 31 stores this determined value in the memory and uses the value as the paper feeding timing.

In the case of the drive motor 30 used in the first embodiment, a time required for building-down of the drive motor 30 when the process speed was switched from the first process speed (0.09 m/s in the first embodiment) to the second process speed (0.045 m/s in the first embodiment) was about 0.2 to 0.3 seconds taking into account individual differences, environmental differences, and endurance variation. Thus, in the first embodiment, the switching of the speed of the motor was started simultaneously with the start of the detection of the number of motor rotations, and the detection time was set to 0.5 seconds in total including a margin.

Figure 3:
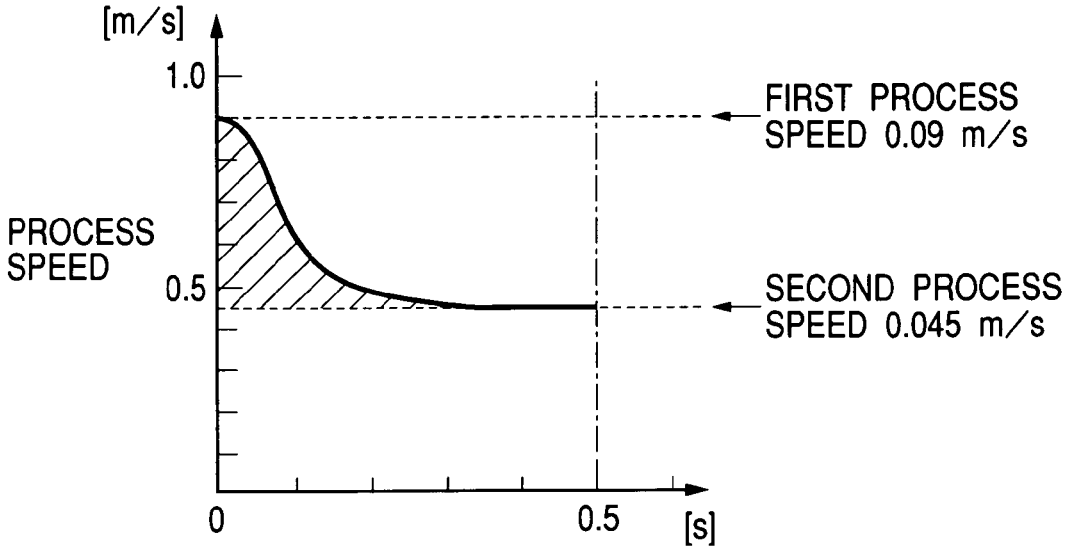
FIG. 3 is a graph showing a change in a process speed from the start until the end of detection of the number of motor rotations according to the first embodiment of the present invention.

FIG. 3 is a graph showing the number of motor rotations (process speed of the intermediate transfer belt) with respect to an elapsed time from the start until the end of the detection of the number of motor rotations.

First, by detecting the total number of rotations of the motor in 0.5 seconds with detecting means, the CPU 31 calculates a total moving distance $\alpha$ of the intermediate transfer belt 1 moving in 0.5 seconds from the start of building-down of the drive motor 30.

A value $\gamma$, which is found by deducting an intermediate transfer belt moving distance $\beta$ in 5 seconds (in this embodiment, a distance "0.045 m/s×0.5 s=0.0225 m" the intermediate transfer belt 1 moved at the second process speed 0.045 m/s in 0.5 seconds) in the case in which the motor building-down time is neglected (0 s) from the calculated total moving distance $\alpha$ ($\gamma=\alpha-\beta$), is a moving distance of the intermediate transfer belt 1 to be generated for the building-down of the motor (corresponding to the shaded part in FIG. 3).

It is necessary to correct this moving distance $\gamma$ to adjust the paper feeding timing and effect registration of an image leading end and a transfer material's leading end. The paper feeding timing in the case in which the motor building-down time is neglected (0 s) can be calculated if a process speed has been determined. In this embodiment, paper feeding timing T0 in the case in which the motor building-down time is neglected (0 s) is set and stored in advance.

The CPU 31 stores timing of T, which is found by deducting time T1=$\gamma$/PS2 in which the intermediate transfer belt 1 moves the moving distance $\gamma$ for the motor building-down (the shaded part in FIG. 3) at the conveying speed PS2 of the transfer member (second process speed) from the set value T0, (T=T0−T1) as final paper feeding timing.

The CPU 31 uses this stored paper feeding timing as paper feeding timing at the time of every image formation to thereby make it possible to optimize a paper leading end registration.

At the time of image formation, the image forming apparatus performs the image formation at the paper feeding timing found in the paper feeding timing acquisition sequence, builds up the motor to the first process speed after finishing the secondary transfer step and the fixing step, starts the image formation again, and repeats the process to perform continuous printing.

Note that, in the case in which a pulse motor (stepping motor) is used for the drive motor 30 of the intermediate transfer belt 1, since fluctuations in rotation, building-up, and building-down of the motor can be controlled to some extent by pulse control, it is relatively easy to adjust a positional relation between an image leading end and a paper leading end. However, for example, in the case of adopting a DC motor, fluctuation in a rotation speed during building-up and building-down of the motor at the time of process speed switching is increased in accordance with individual differences due to a manufacturing error of the motor, fluctuations in driving torque due to an environment in which the image forming apparatus is placed, fluctuations in driving torque due to endurance, and the like. Thus, it is very difficult to adjust the positional relation between the image leading end and the recording material leading end.

Therefore, measurements are taken so that it becomes possible to adjust a positional relation between an image leading end and a recording material leading end by, for example, providing means which detects the number of rotations of a drive motor for driving to rotate an intermediate transfer member, detecting the number of rotations during building-down of the motor at the time of process speed switching, calculating fluctuations in a moving distance of the intermediate transfer member which occurs at the time of building-down, and calculating a timing for feeding a recording material to a secondary transfer position on the basis of a result of the calculation.

However, since the number of motor rotations is detected at the time of process speed switching, and paper refeeding timing is calculated on the basis of a result of the detection and fed back, for example, in the case in which a distance form a paper refeeding unit (registration roller 40) to the secondary transfer unit is long, a problem as described below occurs.

In short, after detecting the number of motor rotations, even if it is intended to calculate paper feeding timing and immediately feed back the number of motor rotations to the paper feeding timing, it is probable that paper refeeding is late and a leading end registration cannot be effected. In such a case, in order to adjust a positional relation between a registration of an image leading end and a recording material leading end, it is necessary to optimize a structure and specifications of the apparatus such as a distance from a primary transfer unit to a secondary transfer unit, a distance between a registration roller and a secondary transfer roller, and a process speed.

According to the first embodiment, an effect as described below can be obtained without optimizing the structure and specifications of the apparatus such as a distance from a primary transfer unit to a secondary transfer unit, a distance between a registration roller and a secondary transfer roller, and a process speed.

In short, according to the first embodiment, the paper feeding timing acquisition sequence is executed in the initial sequence at the time of input of a power supply to calculate paper feeding timing. Thus, it becomes possible to provide an image forming apparatus without the necessity of detection and control of the number of motor rotations and a process speed at the time of every image formation, and in particular, without limitation on an apparatus structure and the like. As a result, it becomes possible to obtain a satisfactory image with a paper leading end registration regardless of individual differences, environmental fluctuations, and endurance fluctuations of a motor.

Second Embodiment

Figure 4:
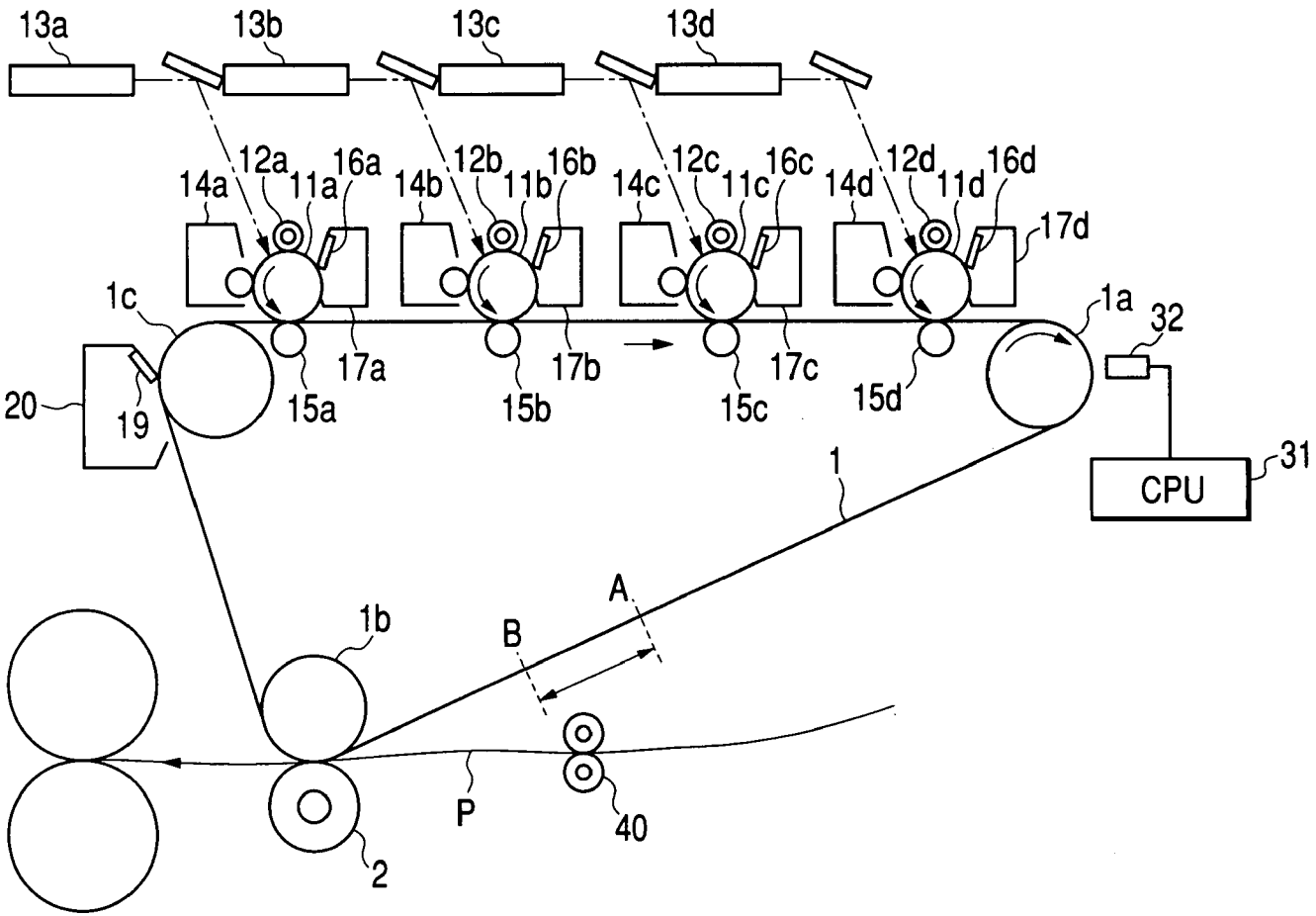
FIG. 4 is a sectional view showing a schematic structure of an image forming apparatus according to a second embodiment of the present invention.

FIG. 4 is a sectional view showing a schematic structure of a "color image forming apparatus" according to a second embodiment. Components identical with those in FIG. 1 are denoted by identical reference numerals and symbols and will not be described again. This embodiment is an example in which, at the time of initial rotation, a pattern for detecting a conveying speed of a belt is formed on the intermediate transfer belt 1, a conveying speed of the intermediate transfer belt 1 is detected by a sensor for concentration detection 32 opposed to the drive roller 1*a*, a building-down amount of a process speed is calculated, paper feeding timing is calculated, a calculated timing value is stored in storing means, and paper feeding timing is determined on the basis of the stored value at the time of image formation.

An operation of this embodiment will be hereinafter described more in detail.

At the time of initial rotation such as the time of input of a power supply, the CPU 31 carries out a paper feeding timing acquisition sequence by the intermediate transfer belt 1 at arbitrary timing. In a state in which the intermediate transfer belt 1 is driven at a first process speed, an image for conveying speed detection is formed by at least one arbitrary station. In this embodiment, pattern formation by a fourth station is performed, and lateral lines are formed at equal intervals in a conveying direction of the intermediate transfer belt 1 as a pattern. In this embodiment, the pattern of lateral lines formed at intervals of 1 mm (pattern for speed detection) was used.

Next, simultaneously with the pattern for speed detection reaching the part of the sensor for concentration detection 32, the CPU 31 reads the pattern and starts detection of a conveying speed.

In this embodiment, a concentration detection sensor for concentration control is used for the sensor 32 and light of an LED is irradiated on the intermediate transfer belt 1 to read amounts of reflected light on an image forming area and a non-image forming area, whereby the CPU 31 calculates a conveying speed and a conveying distance of the intermediate transfer belt 1.

After starting detection of the pattern by the sensor 32, the CPU 31 switches a process speed from the first process speed to the second process speed and calculates a conveying distance of the intermediate transfer belt 1 at the time of process speed switching by integrating a process speed and a time period at each timing until the process speed is switched to the second process speed.

The CPU 31 calculates a time T2 in which the intermediate transfer belt 1 moves this conveying distance at the second process speed, finds T' by deducting a result of the calculation from paper feeding timing T0 set and stored in advance as in the first embodiment (T'=T0−T2), and stores the timing of T' as final paper feeding timing.

Thereafter, after a trailing end of the pattern for speed detection is cleaned by a cleaning member, the rotation is stopped and the intermediate transfer belt 1 is brought into a standby state in preparation for image formation.

In subsequent image formation, a paper feeding operation is performed according to the stored paper feeding timing T', and it becomes possible to perform image formation with a registration of a paper leading end.

As described above, according to the present invention, the paper feeding timing acquisition sequence by the intermediate transfer belt is executed in the initial sequence at the time of input of a power supply to calculate paper feeding timing, and the sensor for concentration control is used for detecting means. Thus, it becomes unnecessary to provide an image forming apparatus with a simpler structure and, in particular, without limitation on an apparatus structure and the like. As a result, it becomes possible to obtain a satisfactory image with a paper leading end registration regardless of individual differences, environmental fluctuations, and endurance fluctuations of a motor.

Third Embodiment

An "image forming apparatus," according to a third embodiment will be described. This embodiment is an example in which the image forming apparatus has, in addition to a second process speed for coping with cardboard, rough paper, and the like, a third process speed for coping with other media such as an OHT. Since a schematic structure of this embodiment is the same as the first embodiment, FIG. 1 and the description of FIG. 1 are applied, and the structure will not be described here.

In this embodiment, a process speed at the time of normal image formation (first process speed) is set to 0.09 m/s, and the second process speed is set to 0.045 m/s, which is half the first process speed, as a cardboard and rough paper mode. In addition, the third process speed is set to 0.03 m/s, which is ⅓ the process speed at the time of normal image formation (first process speed), as an OHT mode.

Figure 5:
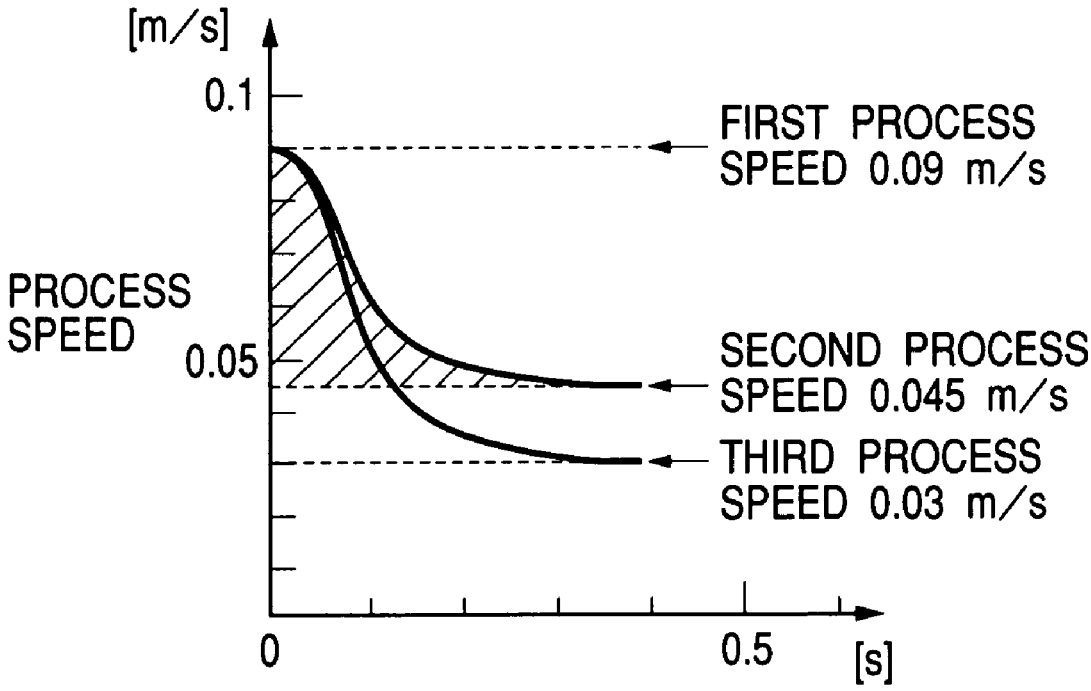
FIG. 5 is a graph showing a change in a process speed from the start until the end of detection of the number of motor rotations according to a third embodiment of the present invention.

FIG. 5 is a graph showing a process speed of the intermediate transfer belt 1 with respect to time from the start until the end of detection of the number of motor rotations. Note that, a rotation speed (process speed) of the intermediate transfer belt 1 can be calculated from the number of motor rotations because the rotation speed is in a proportional relation with the number of motor rotations.

First, as in the first embodiment, the CPU 31 calculates a conveying speed and a conveying distance of the intermediate transfer belt 1 for building-down of the motor 30 from the first process speed to the second process speed, calculates paper feeding timing in the case of the cardboard and rough paper mode on the basis of a result of the calculation, and stores the paper feeding timing.

Next, after determining the paper feeding timing in the case of the cardboard and rough paper mode, the CPU 31 builds up the motor 30 to the first process speed again. After completing the building-up, with the same procedure as detecting building-down to the second process speed, the CPU 31 calculates a conveying speed and a conveying distance of the intermediate transfer belt 1 for building-down of the motor 30 from the first process speed to the third process speed, calculates paper feeding timing in the case of the OHT mode on the basis of a result of the calculation, and stores the paper feeding timing.

On the basis of this stored value, the CPU 31 calls the paper feeding timing in accordance with a mode selected at the time of image formation to perform an image forming process.

Consequently, as in the first embodiment, the paper feeding timing acquisition sequence is executed in the initial sequence at the time of input of a power supply to calculate paper feeding timing. Thus, it becomes possible to provide an image forming apparatus without the necessity of detection and control of the number of motor rotations and a process speed at the time of every image formation, and in particular, without limitation on an apparatus structure and the like. As a result, it becomes possible to obtain a satisfactory image with a paper leading end registration regardless of individual differences, environmental fluctuations, and endurance fluctuations of a motor.

Fourth Embodiment

A fourth embodiment of the present invention will be described on the basis of FIGS. 6 to 10.

(Apparatus Structure)

First, a structure of an apparatus in accordance with the present invention will be described.

Figure 8:
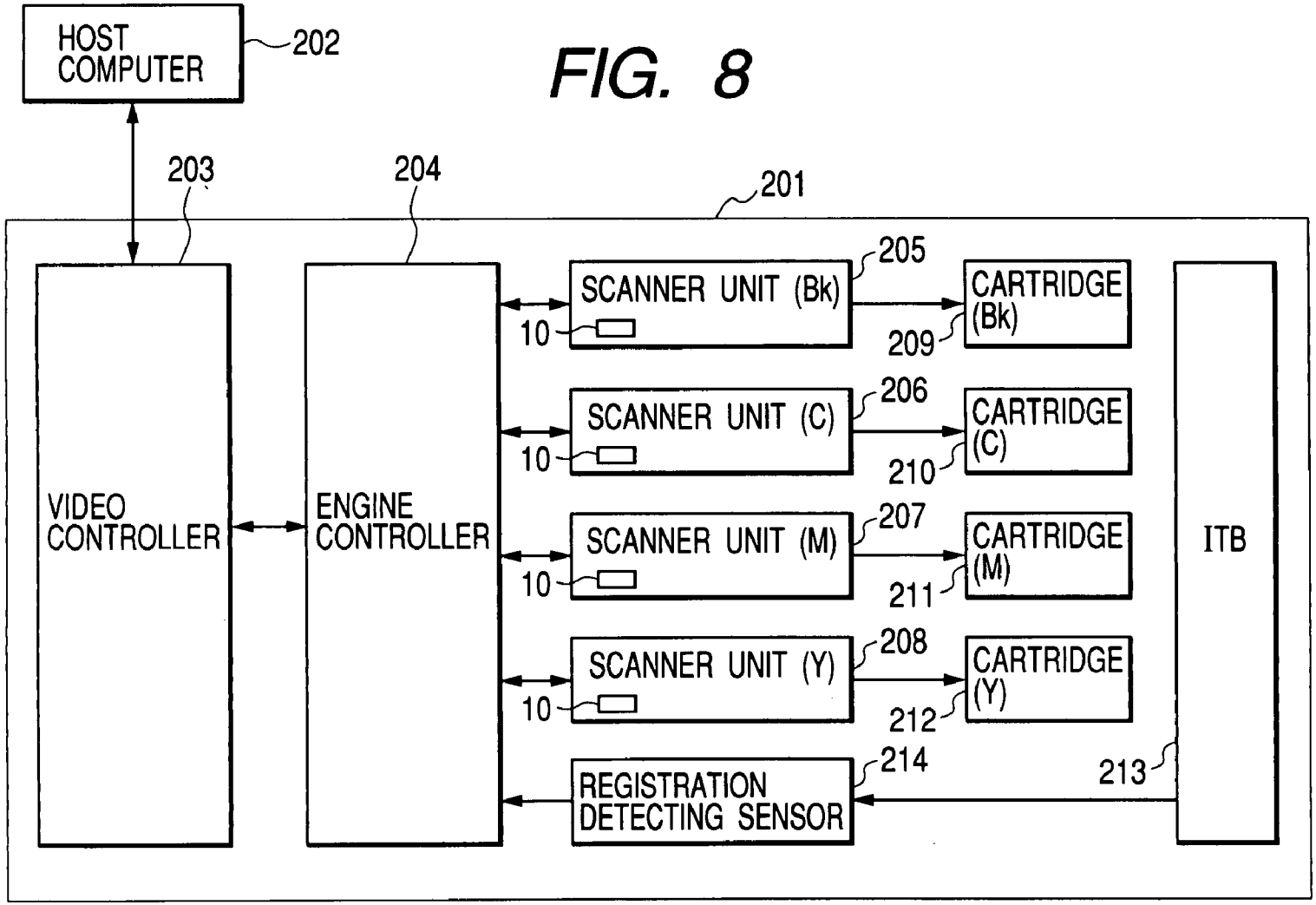
FIG. 8 is a block diagram showing a schematic structure of an image forming apparatus.

FIG. 8 is a color image forming apparatus which is applicable to the present invention.

Reference numeral 201 denotes a laser printer serving as the color image forming apparatus. In the fourth embodiment, a color laser printer of a four-drum type will be described as an example.

The color laser printer 201 includes image forming units of four colors in order to form a color image obtained by superimposing images of four colors (yellow Y, magenta M, cyan C, and black Bk) one on top of another.

The image forming units include toner cartridges 209 to 212, which have photosensitive drums 301 to 304 serving as an image bearing members, respectively, and scanner units 205 to 208, which have laser diodes (LDs) 10 generating a laser beam as a light source for image exposure. The toner cartridges 209 to 212 and the scanner units 205 to 208 are provided for the four colors, respectively.

Figure 9:
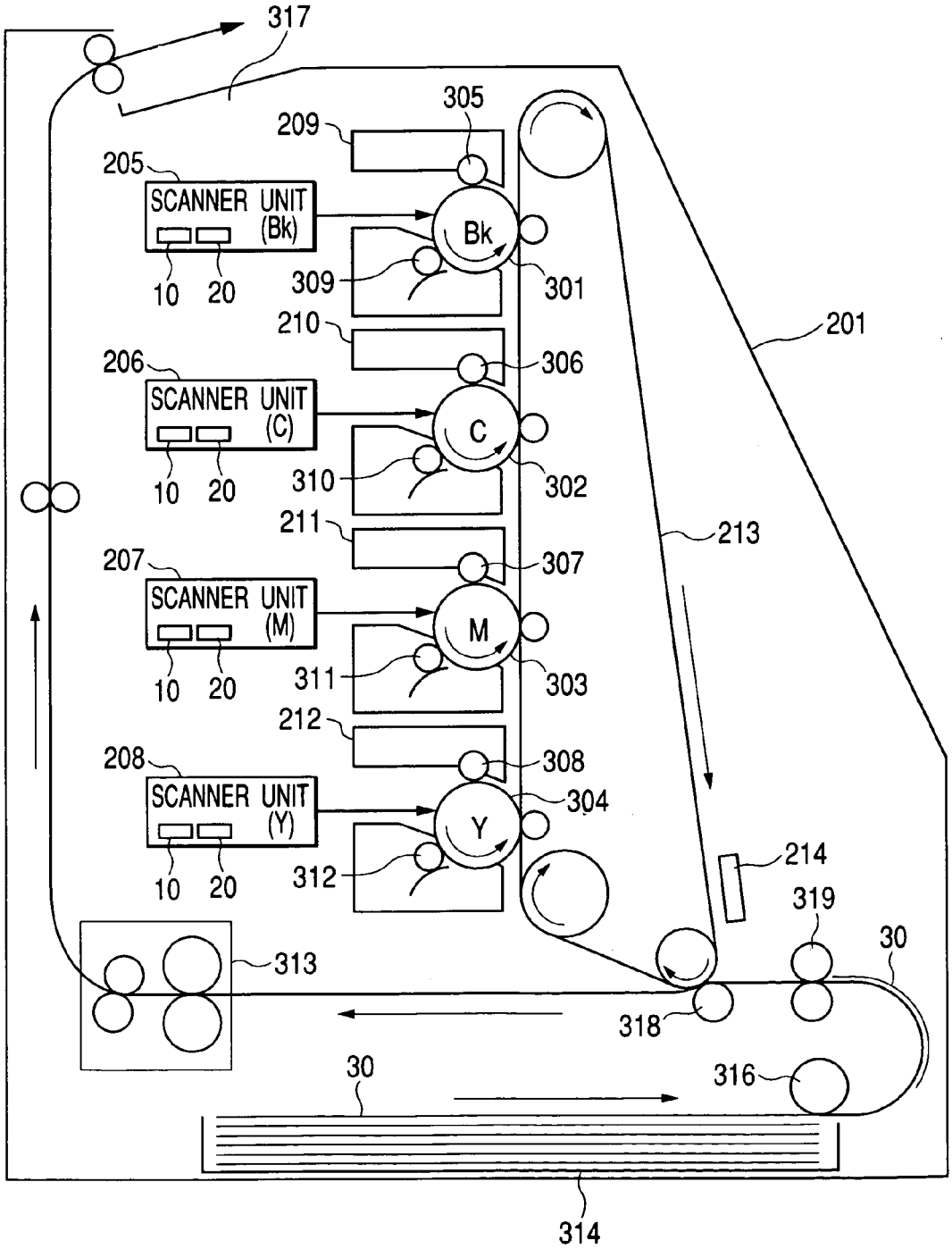
FIG. 9 is a sectional view showing a schematic structure of the image forming apparatus.

FIG. 9 shows a sectional structure of the color laser printer 201.

Reference numerals 301 to 304 denote photosensitive drums, which are used for image formation of black (Bk), cyan (C), magenta (M), and yellow (Y), respectively.

Reference numeral 214 denotes a registration detection sensor. This registration detection sensor 214 monitors a registration (alignment accuracy) of images on an intermediate transfer belt (ITB) 213 serving as an intermediate transfer member. In other words, the registration detection sensor 214 reads positions of images of the respective colors formed on the ITB 213 and feeds back data of the positions to a video controller 203 or an engine controller 204 to thereby adjust registration positions of the images of the respective colors, thus preventing color drift.

Note that, as a technique for preventing color drift using a registration detection sensor, there is known a technique disclosed in Japanese Patent Application Laid-Open No. H1-142673.

Here, an overall flow of image forming processing will be described briefly.

When image data is received from a host computer 202 serving as an external apparatus shown in FIG. 8, the color laser printer 201 develops the image data into bitmap data with the video controller 203 in the laser printer 201 to generate a video signal for image formation.

The video controller 203 and the engine controller 204 perform serial communication to send and receive information. The video signal is sent to the engine controller 204, and the engine controller 204 drives the laser diodes 10 in the scanner units 205 to 208 according to the video signal to form images on the photosensitive drums 301 to 304 in the toner cartridges 209 to 212.

The photosensitive drums 301 to 304 shown in FIG. 9 are in contact with the ITB 213. The images formed on the photosensitive drums 301 to 304 of the respective colors are transferred onto the ITB 213 and superimposed one on top of another, whereby a color image is formed.

The laser diode 10 in the scanner unit 205 generates a laser beam, which is modulated by a video signal generated by the video controller 203, to scan the surface of the photosensitive drum 301. On the other hand, the photosensitive drum 301 is rotated in a direction indicated by an arrow at a constant speed by a drum motor (not shown). The surface of the photosensitive drum 301 is uniformly charged by a charging roller 305. The laser beam, which is modulated by the video signal generated by the video controller 203, scans this surface, whereby an electrostatic latent image is formed. The electrostatic latent image is visualized as a toner image by the developing device 309.

The video controller 203 sends the video signal to the engine controller 204 usually when a predetermined time has passed after detecting an output signal of a beam detect (BD) sensor 20. Consequently, positions for starting formation of images with laser beams on the photosensitive drums 301 to 304 are always aligned.

Images of the respective colors are sequentially transferred onto the ITB 213, which is conveyed at a constant speed, so as to be superimposed one on top of another (primary transfer images). In other words, an image of yellow (Y) is transferred onto the ITB 213 and images of magenta (M), cyan (C), and black (BK) are transferred onto the image of yellow (Y) in this order, and a color image is formed.

The color image formed on the ITB 213 is carried by the ITB 213. On the other hand, a recording material 30 in a paper feeding cassette 314 is picked up by a pickup roller 316 and stops in a position of a registration roller 319. Thereafter, the recording material 30 is conveyed again from the position of the registration roller 319 so as to be at right timing with the image on the ITB 213 in a position of a transfer roller 318.

Then, the color image is pressed by the transfer roller 318 to be transferred from the ITB 213 to the recording material 30. After the image is fixed by heat and pressure from a fixing device 313 on the recording material 30 having the image (secondary transfer image) transferred thereon, the recording material 30 is discharged to a paper discharge tray 317 above the color laser printer 201.

Figure 10:
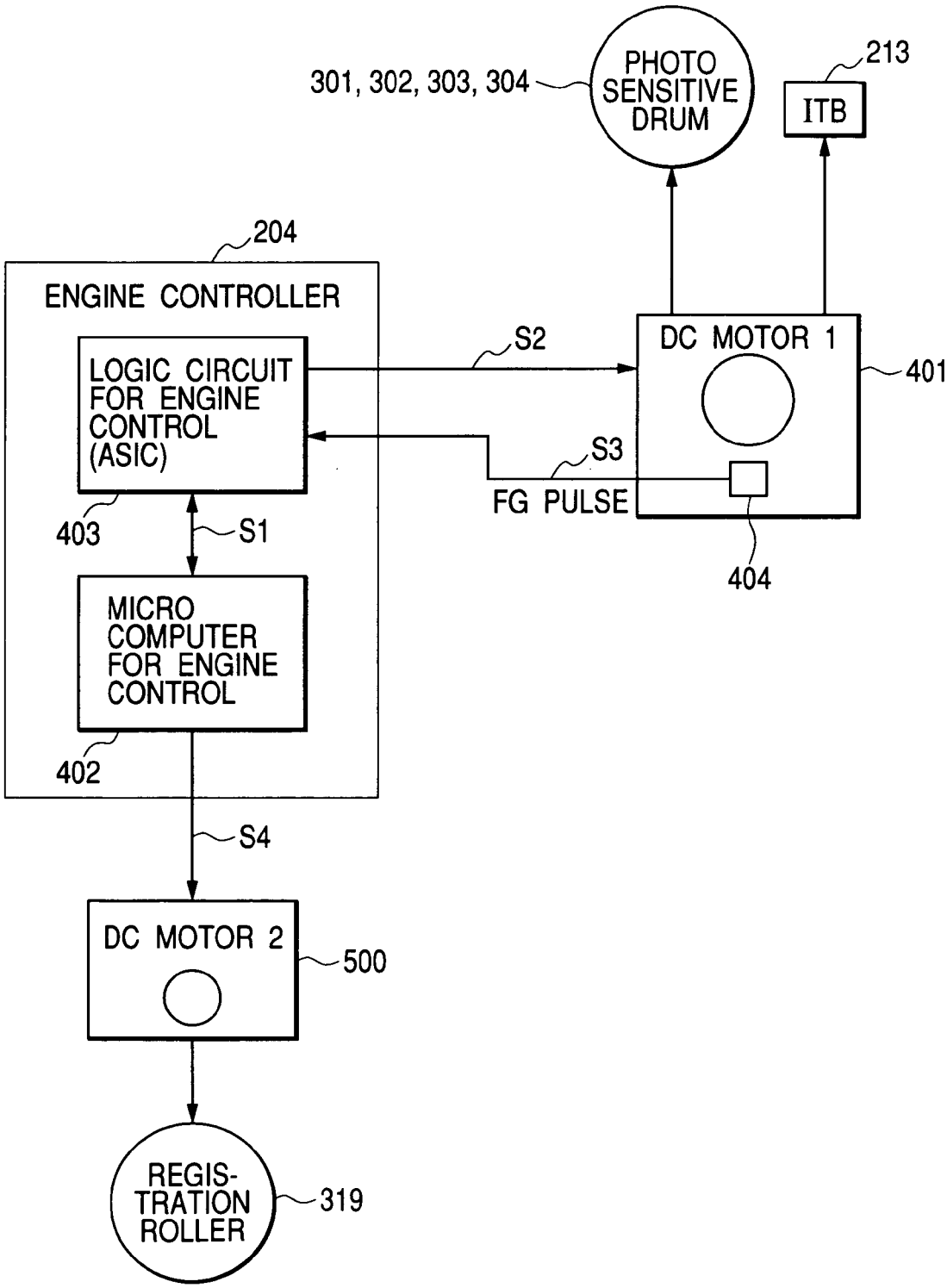
FIG. 10 is a block diagram showing a schematic structure of an engine controller according to the forth embodiment of the present invention.

FIG. 10 shows a structure of the engine controller 204 and devices around the engine controller 204.

The engine controller 204 includes a microcomputer for engine control 402 and a logic circuit for engine control (e.g., ASIC) 403 for controlling a DC motor and other engines.

The logic circuit for engine control 403 outputs a signal S2 on the basis of a signal S1 to be output from the microcomputer 402 to drive and control a DC motor 401.

The DC motor 401 drives the ITB 213 and the photosensitive drums 301 to 304. The DC motor 401 is provided with a position detector 404, which generates a frequency generator (FG) pulse S3 according to the rotation of the DC motor 401. The logic circuit for engine control 403 controls the DC motor 404 such that a frequency of the FG pulse S3 becomes a predetermined frequency.

The microcomputer for engine control 402 outputs a signal S4 to a DC motor 500. Consequently, the DC motor 500 drives various rollers such as the registration roller 319.

(Apparatus Operation)

Next, an image forming operation will be described.

Figure 6:
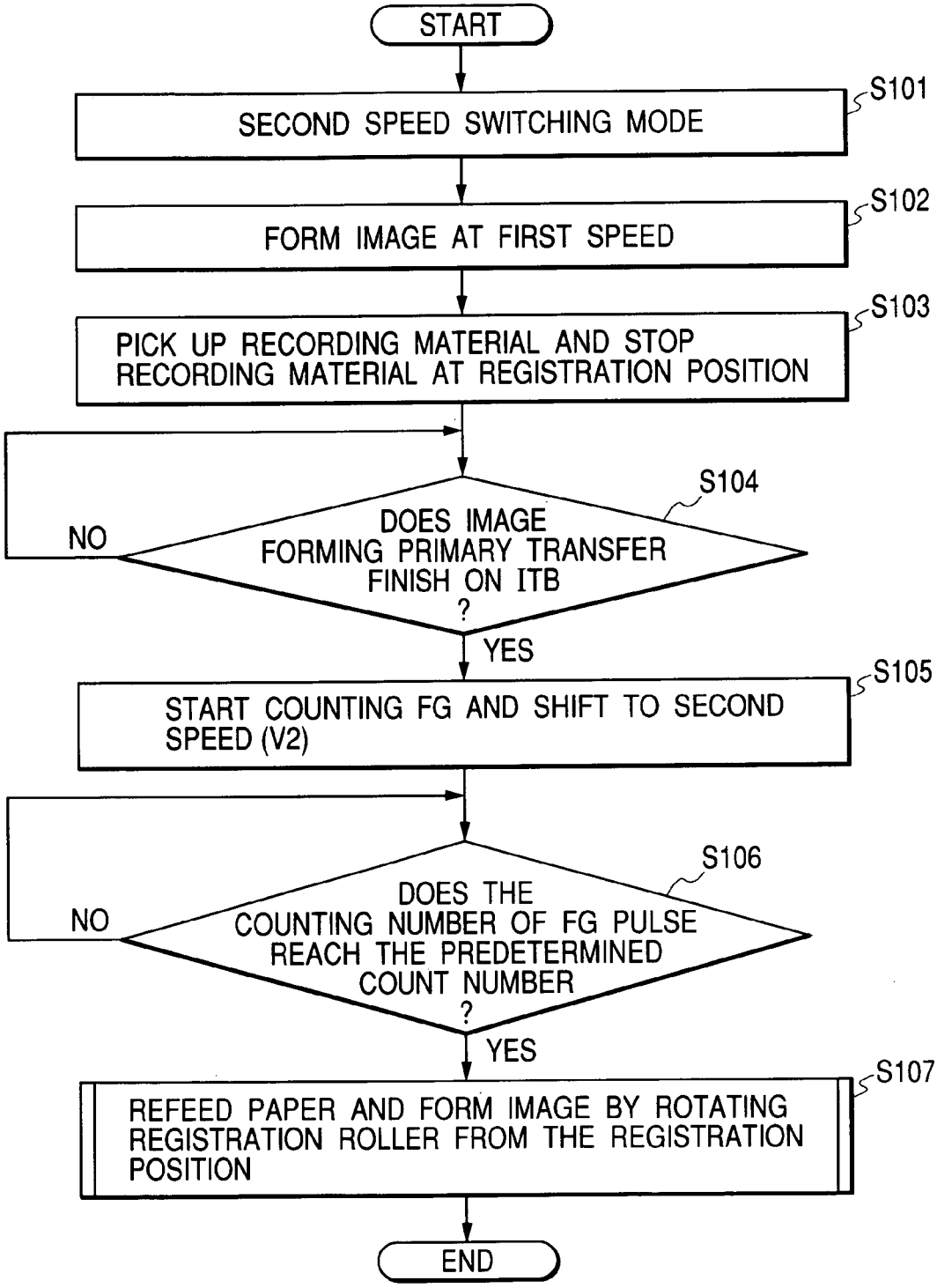
FIG. 6 is a flowchart of an image forming operation according to a fourth embodiment of the present invention.
Figure 7:
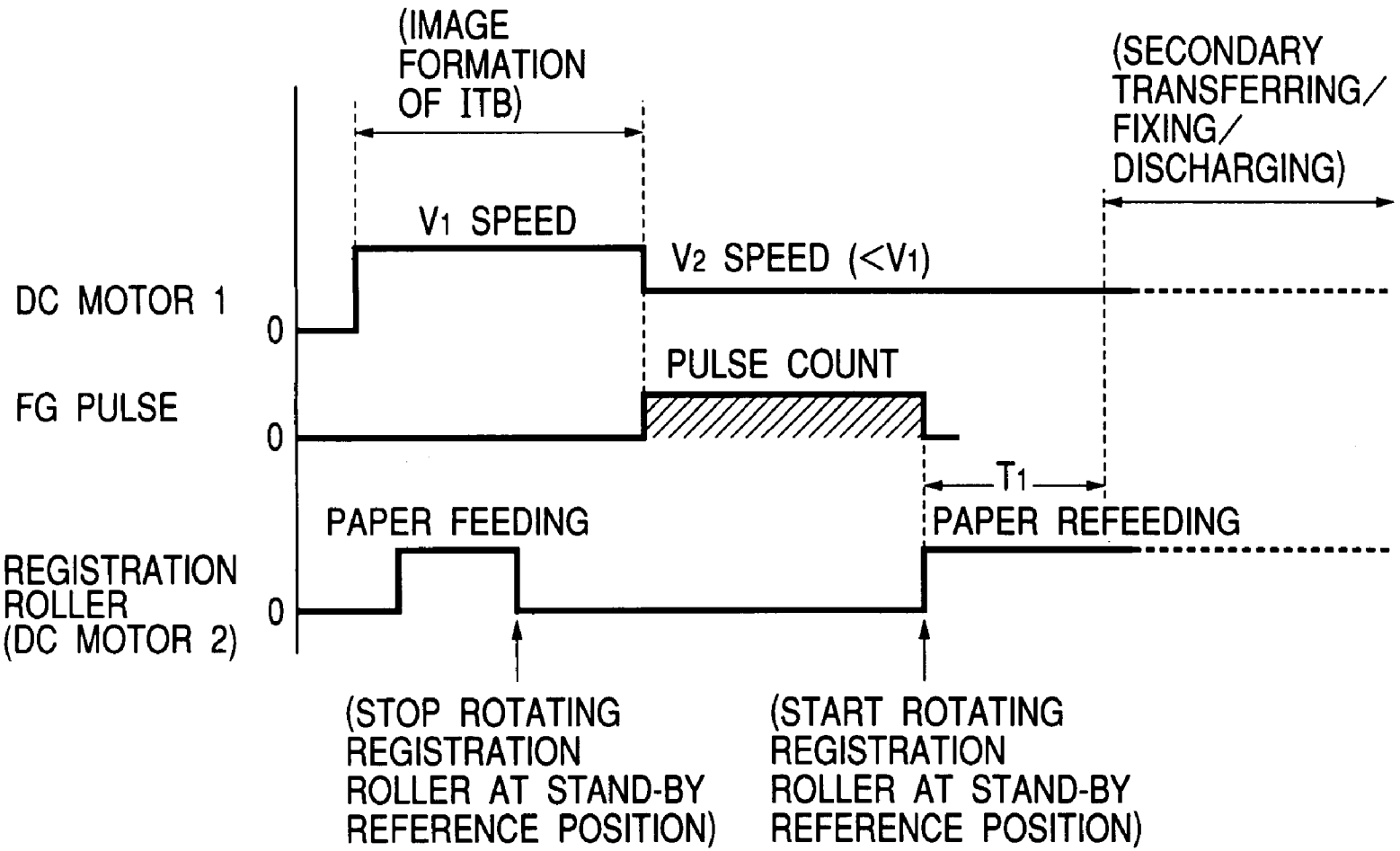
FIG. 7 is a timing chart of the image forming operation according to the fourth embodiment of the present invention.

FIG. 6 is a flowchart showing image forming processing in accordance with the present invention. FIG. 7 is a timing chart for explaining various operations.

When a second speed switching mode is selected (step S101), the engine controller 204 starts image formation at a first speed V1 (step S102).

According to the start of the image formation, the recording material 30 is picked up from the paper feeding cassette 314 and started to be conveyed. Thereafter, the engine controller 204 stops the recording material 30 in a position of the registration roller 319, i.e., a standby reference position (step S103).

On the other hand, the engine controller 204 forms a color image on the ITB 213 and ends the formation processing of a primary transfer image (step S104).

After forming the primary transfer image, as shown in FIG. 7, the engine controller 204 switches a speed of the DC motor 401 to a second speed V2, which is lower than the first speed V1, and starts counting of the FG pulse S3 of the DC motor 401 from predetermined timing (here, timing immediately after the switching which synchronizes with a speed switching signal) (step S105).

When it is detected that the FG pulse S3 has reached a predetermined count number (step S106), the engine controller 204 rotates the registration roller 319 and resumes the conveyance of the recording material 30 from the standby reference position to refeed paper (step S107).

The refed recording material 30 is pressed by the transfer roller 318, and the primary transfer image (color image) transferred on the ITB 213 is transferred onto the recording material 30, whereby a secondary transfer image is formed. After the secondary transfer image formed on the recording material 30 is fixed by the fixing device 313, the recording material 30 is discharged to the paper discharge tray 317.

(Correction for Aberration of a Transfer Position)

Here, a reason for correcting aberration (deviation) of a transfer position of a secondary transfer image by counting the FG pulse S3 until a predetermined count number will be described.

As shown in FIG. 10, in an image forming apparatus which uses the DC motor 401 (DC brushless motor) as a rotation drive motor for the photosensitive drums 301 to 304 and the ITB 213 and uses another DC motor 500 as a motor for paper feeding and conveyance, in the case in which a speed of the DC motor 401 is changed from the first speed V1 to the second speed V2, there are large fluctuations of time in which the speed changes from the first speed V1 to the second speed V2 depending upon individual differences, differences in a change in motor load and a change in a motor drive voltage, and the like of the DC motors 401 and 500.

For example, the speed of the DC motor 401 may be set stable to the second speed V2 in 0.5 seconds in one case and set stable to the second speed V2 in 1 second in another case.

At this time, even if it is intended to manage paper refeeding timing from the position of the registration roller 319 according to time as in the conventional manner, time for conveying the ITB 213 after the speed is switched to the second speed V2 changes, an image leading end position on the ITB 213 fluctuates largely by a value found by the following expression (1) as a positional deviation value.

$$(1\ \text{second} - 0.5\ \text{seconds}) \times V2 \quad (1)$$

Thus, in the present invention, an FG pulse of the DC motor 401 is counted to create paper refeeding timing instead of managing the paper refeeding timing according to time. Consequently, even if time in which the speed changes from the first speed V1 to the second speed V2 fluctuates (i.e., a change in a frequency of the FG pulse fluctuates largely), the number of pulses itself of the FG pulse takes a predetermined value according to a moving distance of the ITB 213 (since a distance of the ITB 213 does not fluctuate, the number of pulses of the FG pulse is fixed), paper can be refed at accurate timing by counting the number of pulses of the FG pulse.

Here, a specific method of correcting deviation of a transfer position will be described.

In the case in which the DC motor 401 driving the ITB 213 and the DC motor 500 conveying the recording material 30 are different, a time T1 in which the recording material 30 moves from the position of the registration roller 319 (standby reference position) to a position of the transfer roller 318, to which an image is secondarily transferred (secondary transfer position), is taken into account in advance. The DC motor 401 is controlled such that an image leading end position of the primary transfer image formed on the ITB 213 is in the secondary transfer position at timing immediately before the time T1 elapses, it becomes possible to form a secondary transfer image free from deviation of a transfer position in a state in which a leading end position of the recording material 30 and the image leading end position of the primary transfer image are always aligned.

Therefore, an FG pulse S shown in FIG. 10 or an encoder output pulse S5 from an encoder 406 shown in FIG. 15 described later is set such that the paper refeeding timing from the position of the registration roller 319 (standby reference position) according to the control of the DC motor 500 is earlier than the timing, at which the image leading end position of the primary transfer image on the ITB 213 moves to the position of the transfer roller 318 according to the control of the DC motor 401 (secondary transfer position), by the time T1.

Timing for refeeding the recording material 30 from the position of the registration roller 319 can be generated by the above-mentioned image forming operation according to a conveying distance of the ITB 213 from the standby reference position. Thus, an image forming apparatus can be obtained which, even in the case in which a profile of a change in speed of the DC motor 401 fluctuates, creates a highly accurate and high quality secondary transfer image free from deviation of an image leading end registration.

In addition, paper feeding timing can be generated by counting an FG pulse for controlling speed of the DC motor 401. Thus, it is unnecessary to include dedicated means such as an encoder separately in order to generate paper feeding timing. Consequently, production costs can be controlled without increasing the number of components.

Fifth Embodiment

A fifth embodiment of the present invention will be described with reference to FIGS. 11 and 12.

The fifth embodiment represents a modification of the image forming operation. Note that, since a basic structure of the image forming apparatus is the same as that in the fourth embodiment (see FIGS. 8 to 10), the structure will not be described here.

Figure 11:
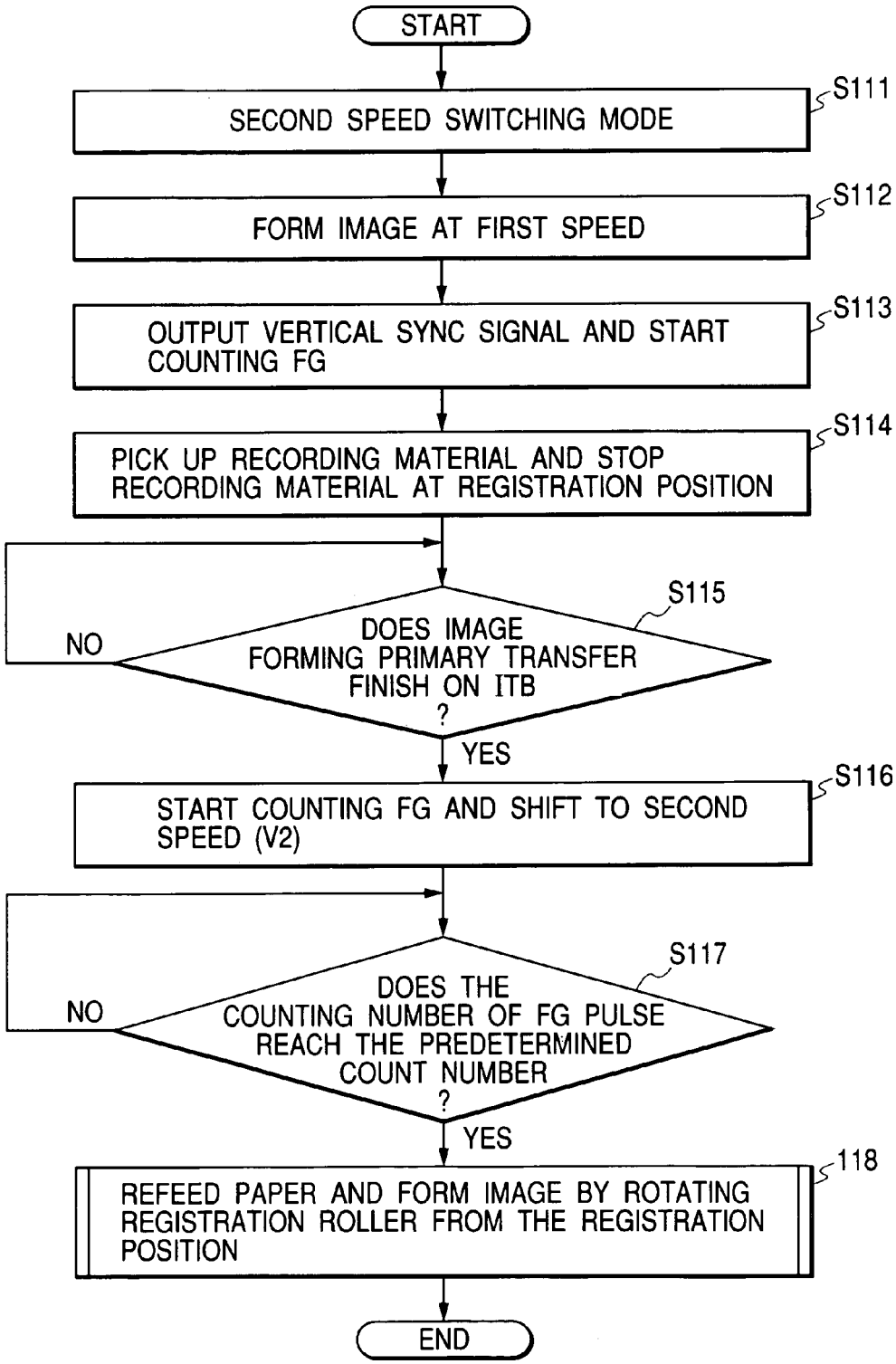
FIG. 11 is a flowchart of an image forming operation according to a fifth embodiment of the present invention.

FIG. 11 is a flowchart showing image forming processing in accordance with the present invention. FIG. 12 is a timing chart for explaining various operations.

An image forming operation in accordance with the present invention will be hereinafter described.

When the second speed switching mode is selected (step S111), the engine controller 204 starts image formation at the first speed V1 (step S112).

Figure 12:
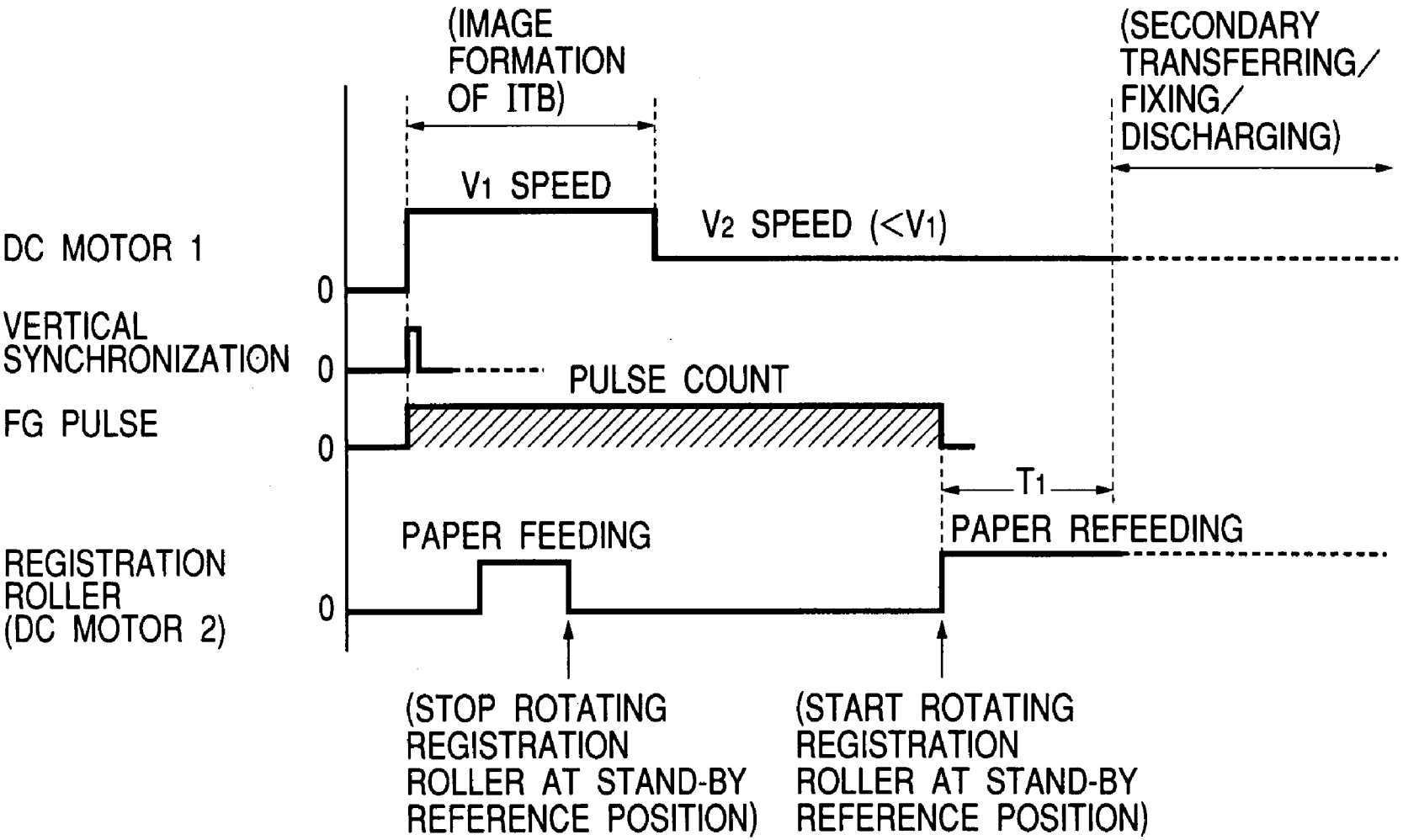
FIG. 12 is a timing chart of the image forming operation according to the fifth embodiment of the present invention.

When the image formation is started at the first speed V1, as shown in FIG. 12, the engine controller 204 generates a vertical synchronizing signal 50 and starts counting of the FG pulse S3 of the DC motor 401 with the vertical synchronizing signal 50 as a trigger (step S113).

Then, after picking up to start conveying the recording material 30 at predetermined timing, the engine controller 204 stops the recording material 30 in the standby reference position of the registration roller 319 (step S114).

This predetermined timing refers to timing after the counting of the FG pulse S3 is started, and usually the timing is in a period for creating an image at the first speed V1.

The engine controller 204 forms a color image on the ITB 213 and ends an operation for forming a primary transfer image (step S115).

After forming the primary transfer image, the engine controller 204 switches the speed of the DC motor 401 to the second speed V2 (<V1) (step S116).

When it is detected that the FG pulse F3 has reached a predetermined count number (step S117), the engine controller 204 rotates the registration roller 319 to start conveying the recording material 30 and transfers the primary transfer image on the ITB 213 onto the recording material 30 to thereby create a secondary transfer image (step S118).

Here, the predetermined count number of step S117 means a count number equivalent to time necessary for entering a secondary transfer image forming period after the speed is switched to the second speed V2.

After ending the secondary transfer, a series of operations for fixing and paper discharge are performed.

Note that the standby reference position, where the engine controller 204 stops the recording material 30, is not limited to the position of the registration roller 214.

In addition, in this embodiment, the example is described in which the recording material 30 is picked up in advance and, then, caused to stand by in the position of the registration roller 214. However, pickup starting timing itself may be controlled.

Timing for refeeding the recording material 30 from the position of the registration roller 319 can be generated by the above-mentioned image forming operation according to a conveying distance of the ITB 213 from a position immediately after starting the image formation. Thus, even in the case in which a change in speed of the DC motor 401 occurs during image formation at the first speed V1, formation of a secondary transfer image free from deviation of an image leading end registration can be performed.

In addition, according to the structure of this embodiment, since the predetermined timing for starting the counting of the FG pulse S3 is identical with the vertical synchronizing signal 50 which is used for aligning an image in the vertical direction. Thus, it is possible to manufacture an image forming apparatus which is capable of obtaining a highly accurate and high quality secondary transfer image free from deviation of an image leading end registration without necessity of generating dedicated timing using a counter or the like of a microcomputer.

Sixth Embodiment

A sixth embodiment of the present invention will be described with reference to FIGS. 13 to 15.

The sixth embodiment represents a modification of the structure and the operation of the image forming apparatus. Note that, since a basic structure of the image forming apparatus is the same as that in the fourth embodiment (see FIGS. 8 and 9), the structure will not be described here.

(Apparatus Structure)

Figure 15:
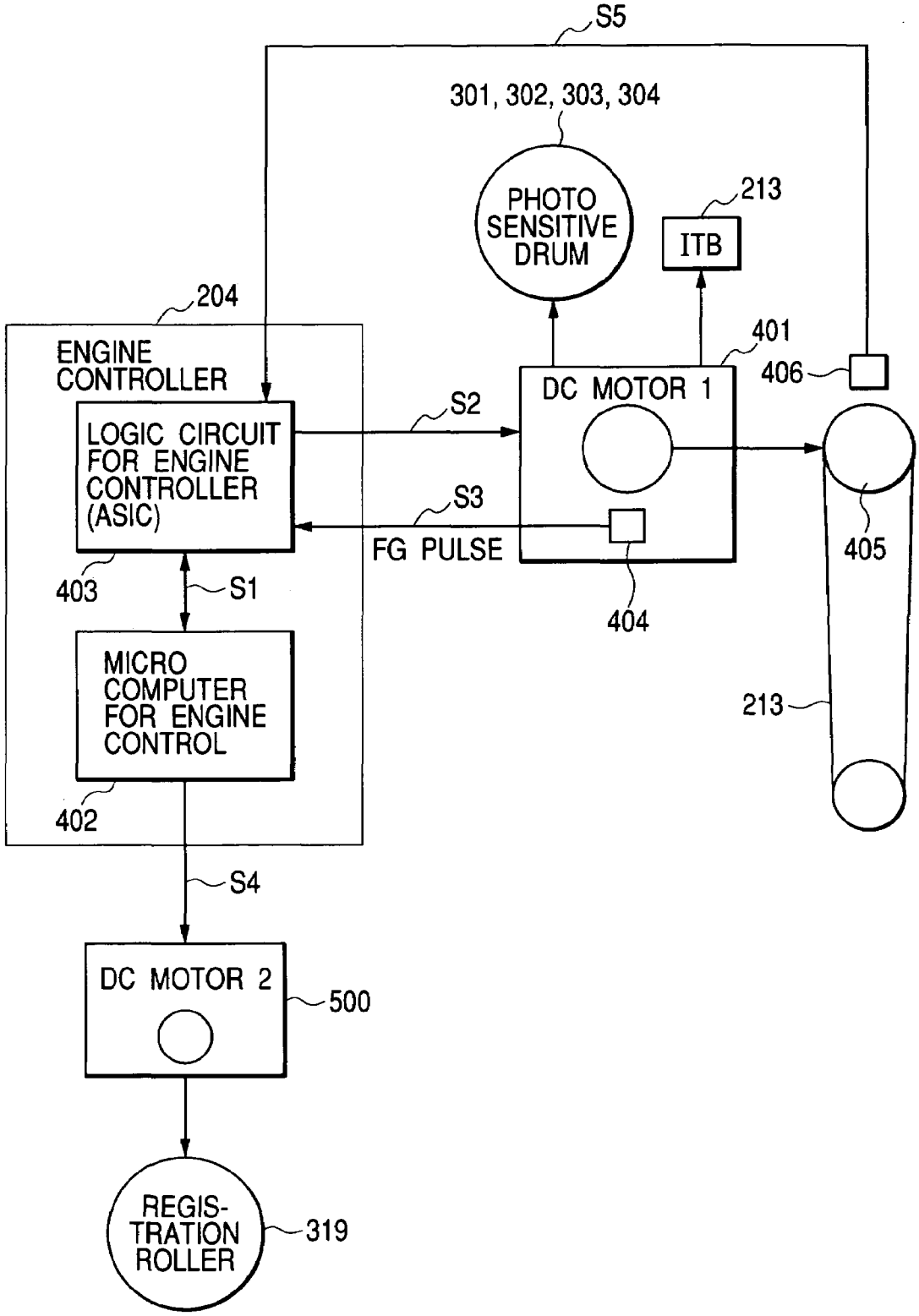
FIG. 15 is a block diagram showing a schematic structure of an engine controller according to the sixth embodiment of the present invention.

FIG. 15 shows the engine controller 204 and devices around the engine controller 204. Note that FIG. 15 is a modification of the structure shown in FIG. 10, and components identical with those in FIG. 10 are denoted by the identical reference numerals and symbols.

The DC motor 401 for driving the ITB 213 is provided with the position detector 404, which generates the FG pulse S3 according to the rotation of the DC motor 401.

The logic circuit for engine control 403 controls the DC motor 404 such that a frequency of the FG pulse S3 becomes a predetermined frequency. The encoder 406 is attached to a shaft of the ITB drive roller 405, which outputs the encoder output pulse S5 according to a rotation angle of the drive roller 405.

The encoder output pulse S5 is inputted to the logic circuit for engine control 403 in the engine controller 204. The logic circuit for engine control 403 can find an accumulated rotation angle of the ITB drive roller 405 by counting the encoder output pulse S5 of the encoder 406.

In addition, the logic circuit for engine control 403 can find a moving distance of the ITB 213 from the count number of the encoder output pulse S5 by calculating a moving distance of the ITB 213 per one pulse of the encoder output pulse S5 in advance.

(Apparatus Operation)

Next, an image forming operation will be described.

Figure 13:
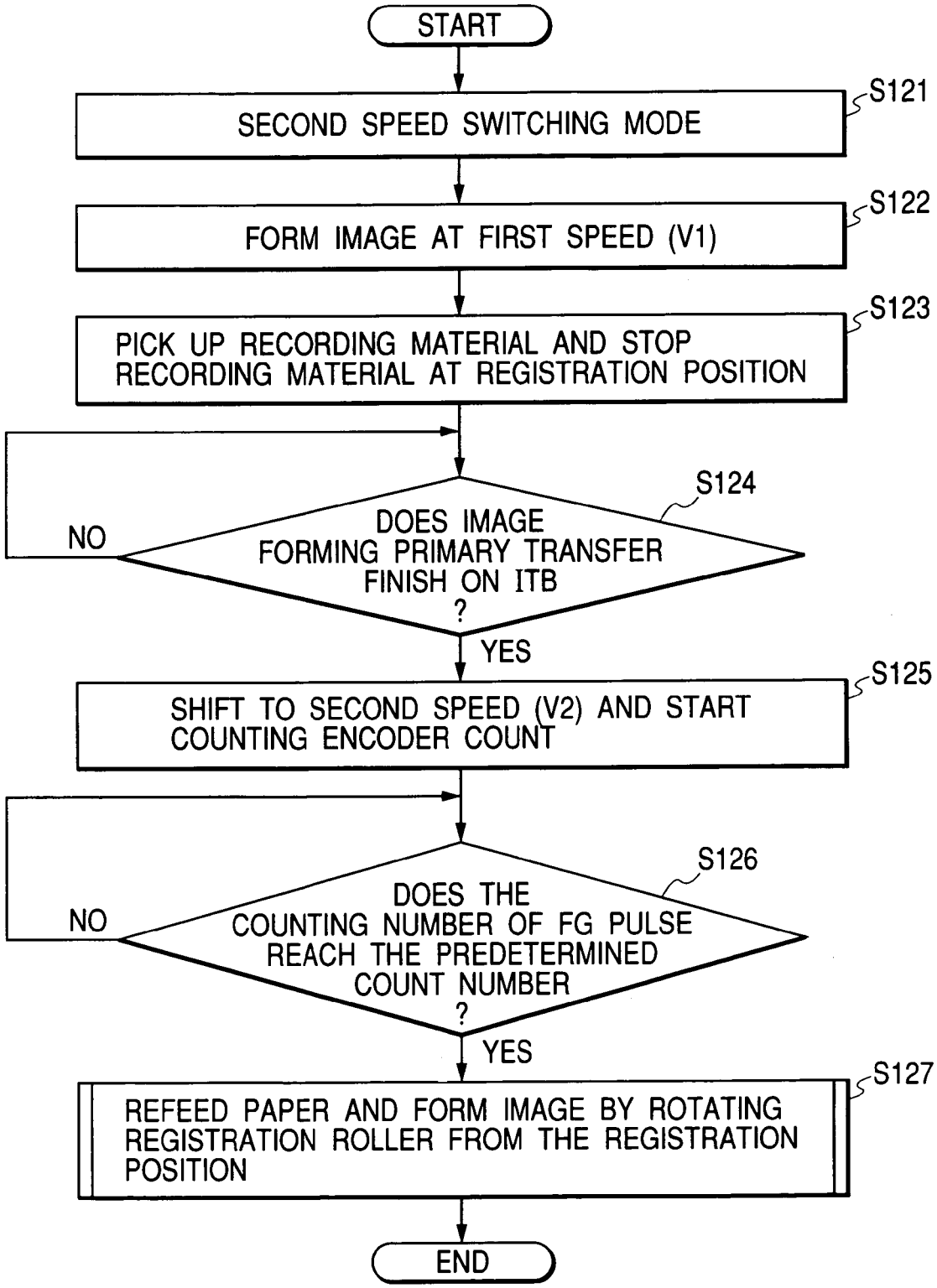
FIG. 13 is a flowchart of an image forming operation according to a sixth embodiment of the present invention.

FIG. 13 is a flowchart showing image forming processing in accordance with the present invention. FIG. 14 is a timing chart for explaining various operations.

When a second speed switching mode is selected (step S121), the engine controller 204 starts image formation at a first speed V1 (step S122).

According to the start of the image formation, the recording material 30 is picked up and started to be conveyed. Thereafter, the engine controller 204 stops the recording material 30 in the standby reference position of the registration roller 319 (step S123).

The engine controller 204 forms an image on the ITB 213 and ends the formation processing of a primary transfer image (step S124).

Figure 14:
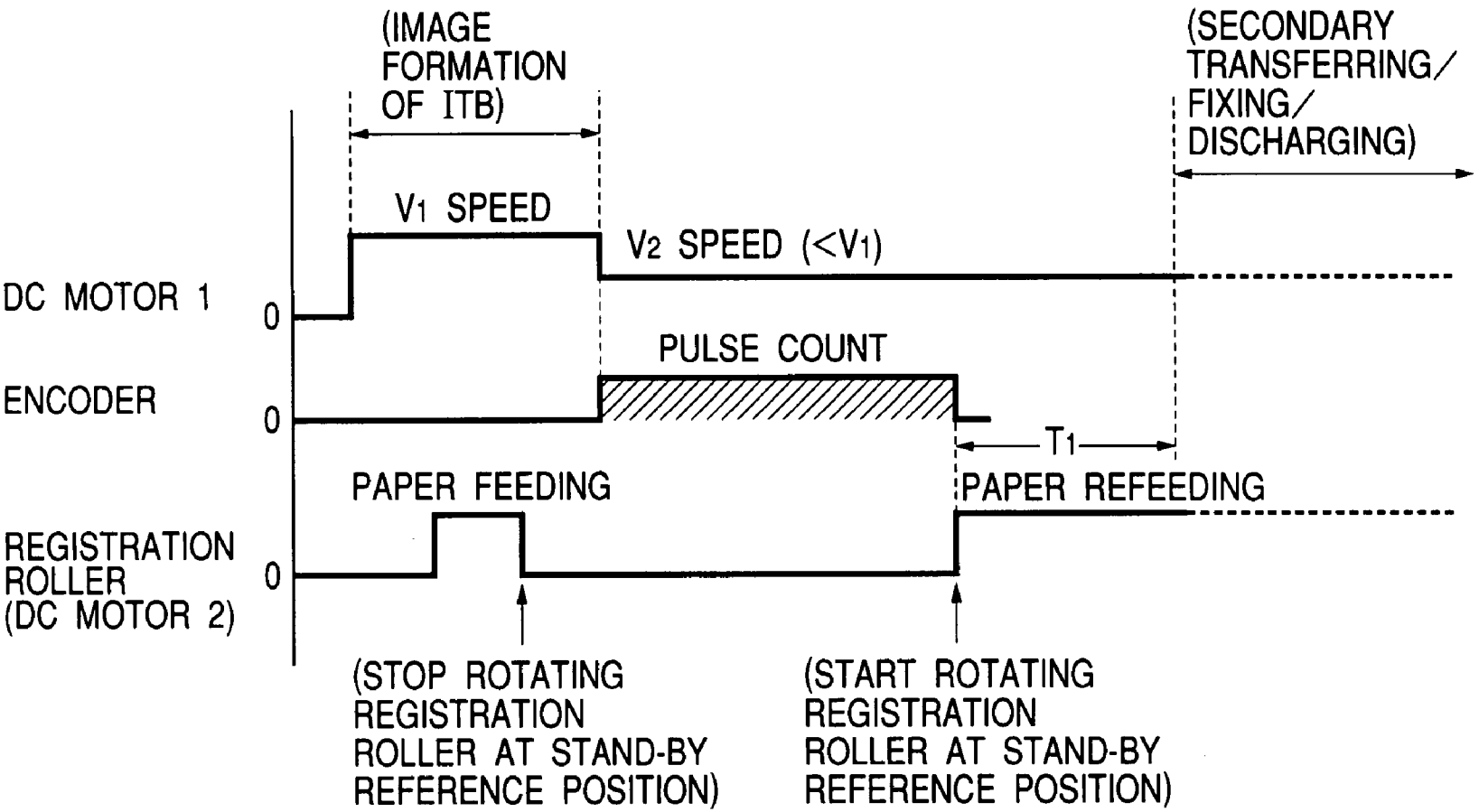
FIG. 14 is a timing chart of the image forming operation according to the sixth embodiment of the present invention.

After forming the primary transfer image, as shown in FIG. 14, the engine controller 204 switches a speed of the DC motor 401 to a second speed V2 (<V1), and starts counting of the encoder output pulse S5 of the encoder 406 from predetermined timing (here, timing immediately after the switching which synchronizes with a speed switching signal) (step S125).

When it is detected that the encoder output pulse S5 has reached a predetermined count number (step S126), the engine controller 204 rotates the registration roller 319 to start conveying the recording material 30 and transfers the primary transfer image on the ITB 213 onto the recording material 30 to thereby create a secondary transfer image (step S127).

Here, as in the first embodiment, the predetermined count number of step S126 means a count number equivalent to time necessary for entering a secondary transfer image forming period after the speed is switched to the second speed V2.

After ending the secondary transfer, a series of operations for fixing and paper discharge are performed.

Refeeding of the recording material 30 from the position of the registration roller 319 can be performed by the above-mentioned image forming operation at timing according to a conveying distance of the ITB 213 from the standby reference position. Thus, even in the case in which a profile of a change in speed of the DC motor 401 fluctuates, formation of a secondary transfer image free from deviation of an image leading end registration can be performed.

In addition, according to the structure of this embodiment, the encoder 406 is attached to the ITB drive roller 405 to find a conveying distance of the ITB 213. Thus, alignment of an image in the vertical direction can be performed at high accuracy by increasing accuracy of the encoder output pulse S5. Consequently, it is possible to obtain a highly accurate and high quality secondary transfer image in which a deviation of an image leading end registration is corrected.

Seventh Embodiment

A seventh embodiment of the present invention will be described with reference to FIGS. 16 and 17.

The seventh embodiment represents a modification of the image forming operation. Note that, since a basic structure of the image forming apparatus is the same as that in the sixth embodiment (see FIG. 15), the structure will not be described here.

Figure 16:
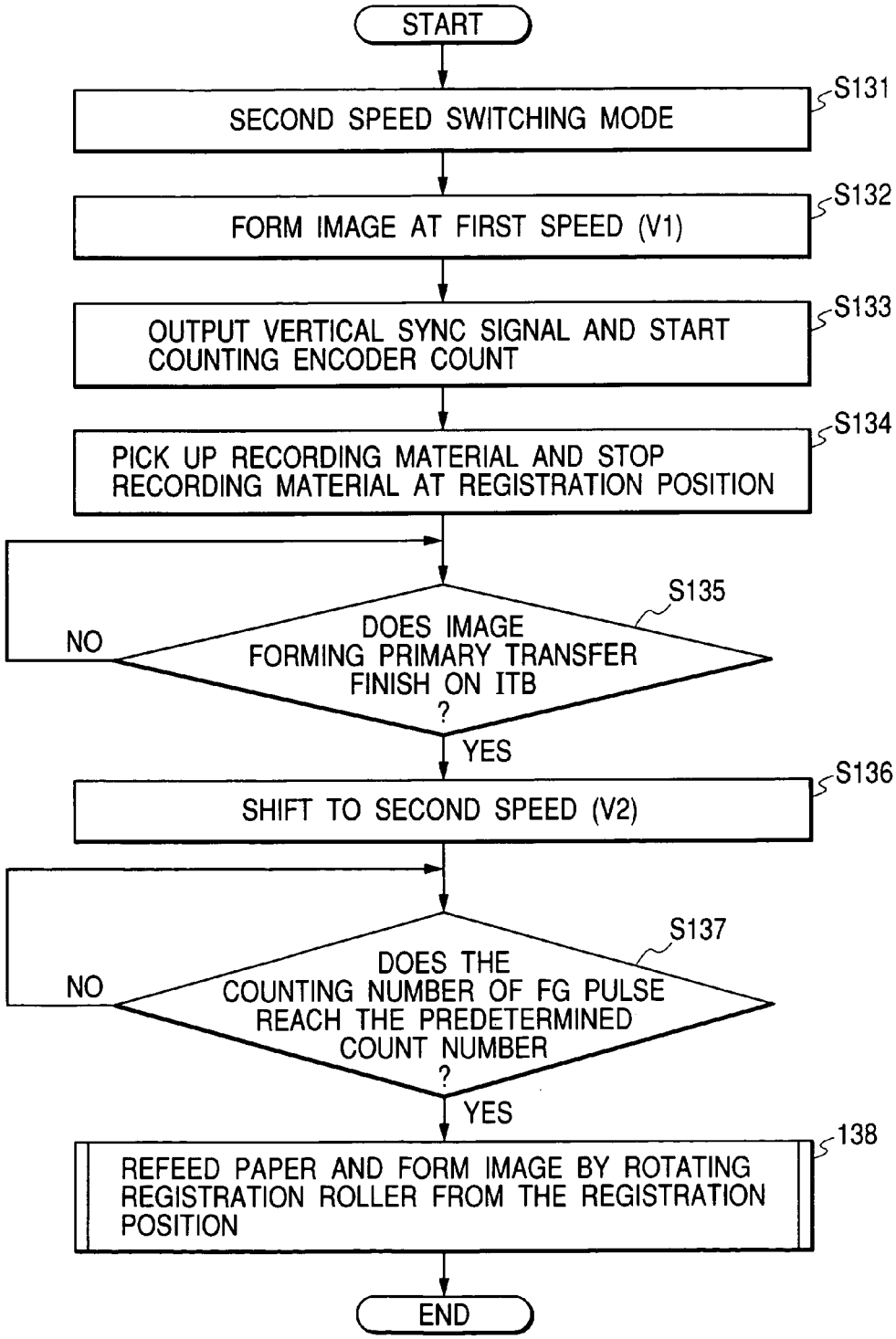
FIG. 16 is a flowchart of an image forming operation according to a seventh embodiment of the present invention.

FIG. 16 is a flowchart showing image forming processing in accordance with the seventh embodiment. FIG. 17 is a timing chart for explaining various operations.

An image forming operation in accordance with the present invention will be hereinafter described.

When the second speed switching mode is selected (step S131), the engine controller 204 starts image formation at the first speed V1 (step S132).

When the image formation is started at the first speed V1, the engine controller 204 generates the vertical synchronizing signal 50 and starts counting of the encoder output pulse S5 of the encoder 406 with the vertical synchronizing signal 50 as a trigger (step S133).

Then, after picking up to start conveying the recording material 30 at predetermined timing, the engine controller 204 stops the recording material 30 in the standby reference position of the registration roller 319 (step S134).

This predetermined timing refers to timing after the counting of the encoder output pulse S5 is started, and usually the timing is in a period for creating an image at the first speed V1.

The engine controller 204 forms a primary transfer image on the ITB 213 (step S135).

Figure 17:
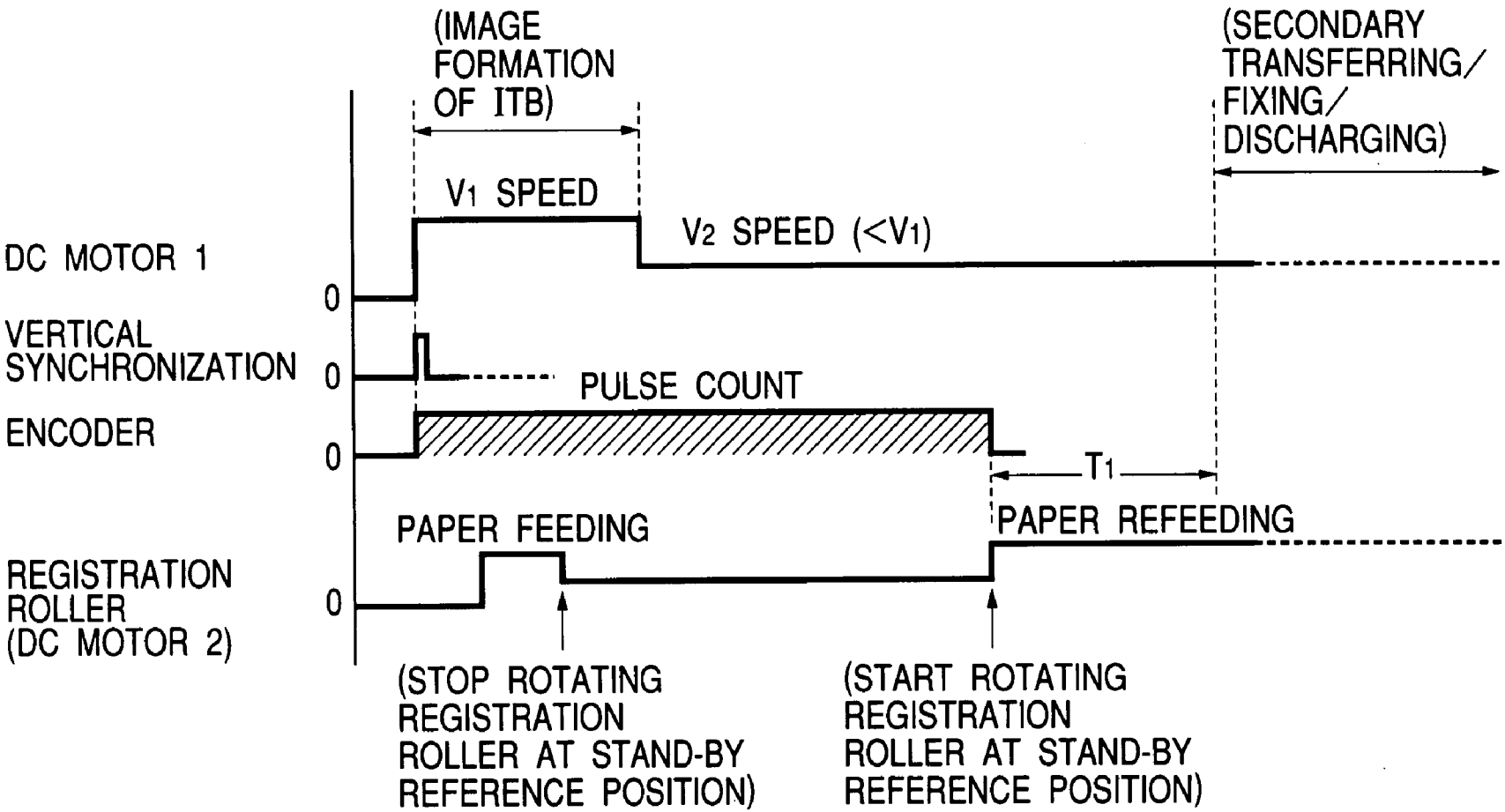
FIG. 17 is a timing chart of the image forming operation according to the seventh embodiment of the present invention.

After forming the primary transfer image, as shown in FIG. 17, the engine controller 204 switches the speed of the DC motor 401 to the second speed V2 (<V1) (step S136).

When it is detected that the encoder output pulse S5 has reached a predetermined count number (step S137), the engine controller 204 rotates the registration roller 319 to start conveying the recording material 30 (step S138).

Here, as in the first embodiment the predetermined count number of step S137 means a count number equivalent to time necessary for entering a secondary transfer image forming period after the speed is switched to the second speed V2.

After ending the secondary transfer, a series of operations for fixing and paper discharge are performed.

Refeeding of the recording material 30 from the standby reference position of the registration roller 319 can be performed by the above-mentioned image forming operation at timing according to a conveying distance of the ITB 213 from a position immediately after starting the image formation. Thus, even in the case in which a change in speed of the DC motor 401 occurs during image formation at the first speed V1, formation of a secondary transfer image free from deviation of an image leading end registration can be performed.

In addition, in the seventh embodiment, the encoder 406 is attached to the ITB drive roller 405 to find a conveying distance of the ITB 213. Thus, deviation of an image in the vertical direction can be corrected at high accuracy by increasing accuracy of the encoder output pulse S5.

Further, according to the structure of the seventh embodiment, predetermined timing for staring the counting of the encoder output pulse S5 is identical with the vertical synchronizing signal 50 used for performing alignment of an image in the vertical direction. Thus, it is possible to manufacture an image forming apparatus which creates a highly accurate and high quality secondary transfer image free from deviation of a positional relation (registration) between an image leading end and a leading end of the recording material P without necessity of generating dedicated timing using a counter or the like of a microcomputer.

Note that it is needless to mention that the present invention is not limited to the above-described embodiment and various modifications are possible within a range of appended claims.

In addition, the above description is made for the case in which an inline image forming apparatus having plural first image bearing members in parallel is used. However, it is needless to mention that this structure can be mounted to a rotary system image forming apparatus, which forms a multiple image on a second image bearing member by repeating image formation plural times from a single first image bearing member, at the time of a mono-color mode, and the same effect can be obtained.

Note that, in the above-mentioned embodiments, the paper feeding timing acquisition sequence is executed in the initial sequence at the time of input of a power supply. However, the timing for the paper feeding timing acquisition sequence is not limited to this, and the paper feeding timing acquisition sequence can be executed at the time of actuation of a concentration control sequence, at the time of actuation of a registration adjustment sequence, or at an arbitrary timing.

What is claimed is:

1. An image forming apparatus, comprising:

an image bearing member for bearing a toner image;

an image forming unit for forming a toner image on said image bearing member;

an intermediate transfer member to which the toner image is primarily transferred from said image bearing member, said intermediate transfer member rotating while being in contact with said image bearing member;

an output unit for outputting information relating to a moving distance at a time when said intermediate transfer member rotates;

a conveying unit which, in an attempt to secondarily transfer the toner image on the intermediate transfer member to a predetermined position on a recording material, starts conveyance of the recording material;

a calculation unit for calculating information relating to a conveyance timing of the recording material on a basis of the information on the moving distance which is output by said output unit at a time when a rotation speed of the intermediate transfer member is switched from a first speed to a second speed lower than the first speed;

a storage unit for storing the information relating to the conveyance timing calculated by said calculation unit; and a control unit for controlling a rotation of an intermediate transfer member and a conveyance of a recording material by said conveying unit, wherein, in a case in which a rotation speed of said intermediate transfer member is switched from the first speed to the second speed lower than the first speed to secondarily transfer the toner image on said intermediate transfer member to the predetermined position on the recording material, said control unit sets a conveyance timing of the recording material by the conveying unit on the basis of the information relating to the conveyance timing stored in said storage unit.

2. An image forming apparatus according to claim 1, wherein said calculation unit calculates the information relating to a conveyance timing of the recording material in a preparation operation which is executed before said image forming unit forms an image on said image bearing member.

3. An image forming apparatus according to claim 1, further comprising:

a drive motor for rotating said intermediate transfer member; and a motor rotation number detection unit for detecting a number of rotations of said drive motor, wherein said output unit outputs the information on the moving distance on a basis of the number of rotations of said drive motor detected by said motor rotation number detection unit.

4. An image forming apparatus according to claim 1, further comprising a toner image detection unit for detecting the toner image on said intermediate transfer member, wherein:

said toner image detection unit detects plural toner images which are formed on the image bearing member by the image forming unit at predetermined intervals, the plural toner images being primarily transferred onto said intermediate transfer member; and said output unit outputs the information on the moving distance on a basis of a result of the detection of the plural toner images formed at the predetermined intervals which are detected by said toner image detection unit.

5. An image forming apparatus according to claim 1, wherein:

said calculation unit calculates a first information relating to a conveyance timing of the recording material on the basis of the information on the moving distance which is output by the output unit at the time when the rotation speed of the intermediate transfer member is switched from the first speed to the second speed lower than the first speed, and calculates a second information relating to a conveyance timing of the recording material on the basis of the information on the moving distance which is output by the output unit at the time when the rotation speed of the intermediate transfer member is switched from the first speed to a third speed lower than the second speed;

said storage unit stores the first information and the second information calculated by the calculation unit; and said control unit controls sets a first conveyance starting timing of the recording material by the conveying unit on a basis of the first information stored in the storage unit in the case in which the rotation speed of the intermediate transfer member is switched from the first speed to the second speed lower than the first speed to secondarily transfer the toner image on the intermediate transfer member to the predetermined position on the recording material, and controls sets a second conveyance starting timing of the recording material by the conveying unit on a basis of at the second information stored in said storage unit in the case in which the rotation speed of the intermediate transfer member is switched from the first speed to the third speed lower than the second speed to secondarily transfer the toner image on the intermediate transfer member to the predetermined position on the recording material.

6. An image forming apparatus, comprising:

an image bearing member for bearing a toner image;

an image forming unit for forming a toner image on the image bearing member;

an intermediate transfer member to which the toner image is primarily transferred from the image bearing member, the intermediate transfer member rotating while being in contact with the image bearing member;

an output unit for outputting pulse signals in a number corresponding to a moving distance at the time when the intermediate transfer member rotates;

a conveying unit, in an attempt to secondarily transfer the toner image on the intermediate transfer member to a predetermined position on a recording material, for starting conveyance of the recording material; and a control unit for controlling the rotation of the intermediate transfer member and the conveyance of the recording material by the conveying unit, wherein, in the case in which the rotation speed of the intermediate transfer member is switched from the first speed to the second speed lower than the first speed to secondarily transfer the toner image on the intermediate transfer member to the predetermined position on the recording material, the control unit controls the conveying unit to start the conveyance of the recording material at a timing that the number of pulses output by the output unit after the switching from the first speed to the second speed is started, has reached a predetermined number of pulses.

7. An image forming apparatus according to claim 6, further comprising:

a drive motor for rotating the intermediate transfer member; and a motor rotation number detection unit for detecting the number of rotations of the drive motor, wherein the pulse signals in the number corresponding to the moving distance, which are output by the output unit, are pulse signals in a number corresponding to the number of rotations of the drive motor which are detected by the motor rotation number detection unit.

8. An image forming apparatus according to claim 6, further comprising:

a drive motor for rotating the intermediate transfer member; and a roller rotation detection unit for detecting rotation of at least one of plural rollers which rotate the intermediate transfer member while stretching the intermediate transfer member, wherein the pulse signals in the number corresponding to the moving distance, which are output by the output unit, are pulse signals in a number corresponding to the rotation of the roller which is detected by the roller rotation detection unit.

9. An image forming apparatus, comprising:

an image bearing member for bearing a toner image;

an image forming unit for forming a toner image on the image bearing member;

an intermediate transfer member to which the toner image is primarily transferred from the image bearing member, the intermediate transfer member rotating while being in contact with the image bearing member;

an output unit for outputting pulse signals in a number corresponding to a moving distance at the time when the intermediate transfer member rotates;

a conveying unit, in an attempt to secondarily transfer the toner image on the intermediate transfer member to a predetermined position on a recording material, for starting conveyance of the recording material; and a control unit for controlling the rotation of the intermediate transfer member and the conveyance of the recording material by the conveying unit, wherein, in the case in which the rotation speed of the intermediate transfer member is switched from the first speed to the second speed lower than the first speed to secondarily transfer the toner image on the intermediate transfer member to the predetermined position on the recording material, the control unit controls the conveying unit to start the conveyance of the recording material at a timing that the number of pulses output by the output unit after the formation of the toner image on the image bearing member in the image forming unit is started, has reached a predetermined number of pulses.

10. An image forming apparatus according to claim 9, further comprising:

a drive motor for rotating the intermediate transfer member; and a motor rotation number detection unit for detecting the number of rotations of the drive motor, wherein the pulse signals in the number corresponding to the moving distance, which are output by the output unit, are pulse signals in a number corresponding to the number of rotations of the drive motor which are detected by the motor rotation number detection unit.

11. An image forming apparatus according to claim 9, further comprising:

a drive motor for rotating the intermediate transfer member; and a roller rotation detection unit for detecting rotation of at least one of plural rollers for rotating said intermediate transfer member with giving a tension to said intermediate transfer member, wherein the pulse signals in the number corresponding to the moving distance, which are output by the output unit, are pulse signals in a number corresponding to the rotation of the roller which is detected by the roller rotation detection unit.

12. An image forming apparatus according to claim 9, further comprising an image processing unit which receives image data from an external apparatus and develops the image data, wherein said control unit controls said image forming unit to start formation of the toner image on the image bearing member as an instruction signal, which instructs to start the formation of the toner image on the image bearing member in the image forming unit, is received from said image processing unit.

* * * * *

UNITED STATES PATENT AND TRADEMARK OFFICE

CERTIFICATE OF CORRECTION

PATENT NO. : 7,050,746 B2
APPLICATION NO. : 10/781793
DATED : May 23, 2006
INVENTOR(S) : Masahide Hirai et al.

It is certified that error appears in the above-identified patent and that said Letters Patent is hereby corrected as shown below:

ON THE TITLE PAGE

At Item (56), Foreign Patent Documents, "2002132008 A" should read --2002-132008 A--; "2002318479 A" should read --2002-318479 A--; and "2003215945A" should read --2003-215945 A--.

COLUMN 3

Line 23, "forth" should read --fourth--.
Line 50, "embodiment" should read --embodiment.--.

COLUMN 7

Line 66, "speed" should read --speed,--.

COLUMN 9

Line 28, "form" should read --from--.

COLUMN 12

Line 16, "an" should be deleted.

COLUMN 19

Line 4, "staring" should read --starting--.

COLUMN 20

Line 55, "controls sets" should read --sets--.
Line 63, "controls sets" should read --sets--.
Line 65, "at" should be deleted.

COLUMN 21

Line 50, "plural" should read --a plurality of--.

UNITED STATES PATENT AND TRADEMARK OFFICE

CERTIFICATE OF CORRECTION

PATENT NO. : 7,050,746 B2
APPLICATION NO. : 10/781793
DATED : May 23, 2006
INVENTOR(S) : Masahide Hirai et al.

It is certified that error appears in the above-identified patent and that said Letters Patent is hereby corrected as shown below:

COLUMN 22

Line 42, “plural” should read --a plurality of--
Line 43, “with “ should read --by--.

Signed and Sealed this

Ninth Day of January, 2007

JON W. DUDAS
*Director of the United States Patent and Trademark Office*